US011713937B2

(12) United States Patent
Craig

(10) Patent No.: US 11,713,937 B2
(45) Date of Patent: Aug. 1, 2023

(54) AMBIDEXTROUS FIREARM BOLT ASSEMBLIES AND METHODS OF USING THE SAME

(71) Applicant: Robert J. Craig, St. Catharines (CA)

(72) Inventor: Jeffrey D. Craig, St. Catharines (CA)

(73) Assignee: Robert J. Craig, St. Catharines (CA)

( * ) Notice: Subject to any disclaimer, the term of this patent is extended or adjusted under 35 U.S.C. 154(b) by 0 days.

(21) Appl. No.: 17/986,545

(22) Filed: Nov. 14, 2022

(65) Prior Publication Data

US 2023/0099273 A1 Mar. 30, 2023

Related U.S. Application Data

(63) Continuation of application No. PCT/IB2021/000324, filed on May 14, 2021.

(60) Provisional application No. 62/704,528, filed on May 14, 2020.

(51) Int. Cl.
*F41A 15/14* (2006.01)
*F41A 35/06* (2006.01)

(52) U.S. Cl.
CPC ..... *F41A 35/06* (2013.01); *F41A 15/14* (2013.01)

(58) Field of Classification Search
CPC .. F41A 15/14; F41A 35/06; F41A 3/26; F41A 11/02; F41A 15/10; F41A 15/12; F41A 19/13; F41A 19/30; F41A 19/34; F41A 3/12
USPC ..... 42/25, 16, 46
See application file for complete search history.

(56) References Cited

U.S. PATENT DOCUMENTS

| | | | | | |
|---|---|---|---|---|---|
| 2,465,553 | A * | 3/1949 | Robinson, Jr. | F41A 15/14 | 42/25 |
| 3,494,216 | A | 2/1970 | Haskins | | |
| 3,791,060 | A | 2/1974 | Weaver | | |
| 3,882,625 | A | 5/1975 | Tellie | | |
| 4,553,469 | A * | 11/1985 | Atchisson | F41A 35/02 | 42/25 |
| 4,654,993 | A * | 4/1987 | Atchisson | F41G 1/06 | 42/71.01 |
| 5,305,539 | A * | 4/1994 | Von Kuster | F41G 1/16 | 42/72 |
| 5,678,340 | A * | 10/1997 | Moon | F41A 15/12 | 42/25 |

(Continued)

FOREIGN PATENT DOCUMENTS

| | | |
|---|---|---|
| RU | 2477437 C1 | 3/2013 |
| WO | 2019147723 A1 | 8/2019 |

OTHER PUBLICATIONS

PCT International Search Report re International Application No. PCT/IB2021/000324, dated Oct. 5, 2021.

(Continued)

*Primary Examiner* — Michael D David
(74) *Attorney, Agent, or Firm* — Downs Rachlin Martin PLLC

(57) ABSTRACT

Ambidextrous bolts that allow a user to quickly and easily change the side of the firearm from which a spent casing is ejected by application of a simple switching mechanism that does not require disassembly of the firearm. Aspects of the disclosure also include debris shields for improving the longevity and reliability of extractors, firearms that are configured for ambidextrous operation, methods of using firearms, and methods of modifying firearms to incorporate ambidextrous functionality.

30 Claims, 32 Drawing Sheets

(56) References Cited

U.S. PATENT DOCUMENTS

| | | | | |
|---|---|---|---|---|
| 6,536,150 | B2 * | 3/2003 | Schweikart | F41A 15/12 89/185 |
| 6,560,908 | B2 * | 5/2003 | Murello | F41A 19/13 42/69.02 |
| 7,237,469 | B2 * | 7/2007 | Murello | F41A 5/24 89/187.01 |
| 7,395,626 | B2 | 7/2008 | Zedrosser | |
| 7,469,496 | B1 | 12/2008 | Kellgren | |
| 8,448,363 | B2 * | 5/2013 | Fargnoli | F41A 35/06 42/16 |
| 9,032,860 | B2 | 5/2015 | Faxon | |
| 9,057,572 | B2 * | 6/2015 | Matteson | F41A 15/14 |
| 9,739,554 | B2 * | 8/2017 | McGinty | F41A 15/14 |
| 9,784,514 | B1 * | 10/2017 | Carr | F41A 15/14 |
| 10,036,600 | B2 | 7/2018 | Maranli | |
| 10,386,142 | B2 * | 8/2019 | Brown | F41A 11/02 |
| 10,969,183 | B2 * | 4/2021 | Gibbens | F41A 19/13 |
| 11,022,391 | B2 * | 6/2021 | Shipley | F41A 15/14 |
| 2005/0235543 | A1 * | 10/2005 | Murello | F41A 15/16 42/47 |
| 2006/0070288 | A1 | 4/2006 | Zedrosser | |
| 2013/0125440 | A1 | 5/2013 | Zheng | |
| 2014/0075807 | A1 * | 3/2014 | Lewis | F41A 15/14 42/25 |
| 2014/0076144 | A1 * | 3/2014 | Gomez | F41A 3/64 42/25 |
| 2014/0090283 | A1 * | 4/2014 | Gomez | F41A 3/16 42/25 |
| 2014/0224114 | A1 * | 8/2014 | Faxon | F41A 5/28 89/193 |
| 2018/0356171 | A1 | 12/2018 | Brown | |
| 2019/0271515 | A1 | 9/2019 | Gibbens | |
| 2019/0331446 | A1 | 10/2019 | Brown | |

OTHER PUBLICATIONS

Famas F1—https://www.forgottenweapons.com/rifles/famas-f1/ (Last downloaded on Nov. 18, 2022).

* cited by examiner

AMBIDEXTROUS FIREARM BOLT ASSEMBLIES AND METHODS OF USING THE SAME

RELATED APPLICATION DATA

This application is a continuation of PCT/IB2021/000324, filed on May 14, 2021, and titled "Ambidextrous Firearm Bolt Assemblies and Methods of Using the Same," which application claims the benefit of priority of U.S. Provisional Patent Application Ser. No. 62/704,528, filed on May 14, 2020, and titled "Ambidextrous Firearm Bolt Assemblies and Methods of Using the Same." Each of these applications is incorporated by reference herein in its entirety.

FIELD OF THE INVENTION

The present invention generally relates to the field of firearms. In particular, the present invention is directed to ambidextrous firearm bolt assemblies and methods of using the same.

BACKGROUND

Firearms typically eject spent casings from a side of the firearm, for example, in a lateral or downward direction. Ejection is typically accomplished by cooperation between an extractor and an ejector of a bolt assembly during a rearward motion of the assembly, where the extractor pulls or presses at one side of the casing while the ejector pushes from an opposite side, the combined pull, push, and rearward motion of the bolt resulting in the cartridge being flung through an ejection port of the firearm. Most firearms eject shell casings out of the right side of the firearm because most people are right handed and during use, a right-handed shooter's face is located on the left side of the firearm.

FIGS. 1 and 2 show an upper receiver assembly 102 of a prior art AR-style rifle. Upper receiver assembly 102 includes an upper receiver 104 and a bolt carrier assembly 106 that reciprocates within the upper receiver 104 when the action is cycled for semiautomatic or fully automatic fire. Upper receiver 104 includes an ejection port 108 where spent casings are ejected. FIG. 2 further illustrates the bolt carrier assembly 106. As shown in FIG. 2, bolt carrier assembly 106 includes a bolt carrier 202 and a bolt 204 slidably and rotatably disposed in the bolt carrier. The illustrated prior art example is an AR-style rifle and bolt 204 is an AR-pattern bolt having a plurality of radially extending and circumferentially and evenly spaced lugs 206 (only one labeled) located on a breech-engaging end 208 of the bolt that are configured to engage the breech of the rifle barrel chamber (not shown) and lock the bolt to the chamber when the bolt is rotated. Rotation of bolt 204 is caused by sliding engagement between a cam pin 210 that radially extends from the bolt and a groove 212 in bolt carrier 202. Bolt 204 includes a firing pin bore 216 and a firing pin (not illustrated) slidably disposed in the firing pin bore 216. To fire the rifle, an end of the firing pin extends from a recessed position within bolt 204 to an extracted position to strike a primer of a ammunition cartridge coupled to the breech-engaging end 208 of bolt 204 to ignite the propellent in the casing and propel the bullet out of the rifle.

As is well known in the art, the prior art upper receiver assembly 102, in cooperation with other components of the rifle, is designed to repeatedly (1) load rounds of ammunition from a magazine into the chamber at the end of the rifle barrel, (2) fire the round of ammunition, (3) eject the spent casing from the fired round of ammunition, and then repeat the cycle by loading another round. During the first step of loading a round of ammunition, both the bolt carrier 106 and bolt 204 slide in a forward axial direction. The breech-engaging end 208 of bolt 204 makes contact with a cartridge and pushes the cartridge into the chamber of the rifle barrel. Prior art bolt 204 includes a single extractor 220 and a single ejector 222 that cooperate to engage a bottom end of a new round during the loading step and eject the casing of the spent round during the ejection step. Extractor 220 is pivotally coupled to bolt 204 and a casing-engaging end is resiliently biased in a radially inward direction. The casing-engaging end of the extractor includes a flange that defines a recess that has a complementary shape as a rim on the end of a cartridge. Ejector 222 is slidably disposed in the face of bolt 204 and is resiliently biased in a forward axial direction. During the forward movement of bolt 204, the casing-engaging end of extractor 220 is pressed over and engages the rim on the bottom end of the casing, and a bottom face of the casing presses ejector 222 into a recessed position.

During the forward axial movement of bolt 204, lugs 206 slide through correspondingly shaped recesses in an outer perimeter of the breech of the rifle barrel at a rear end of the chamber and the forward movement of the bolt continues until the breech-engaging end 208 of the bolt 204 comes into contact with a vertical wall in the chamber. After the bolt 204 comes into contact with the wall in the chamber, the forward movement of the bolt 204 is arrested but the bolt carrier 202 continues to move in the forward axial direction, resulting in cam pin 210 sliding along helical groove 212. The helical shape of groove 212 and interaction between the cam pin 210 and the groove causes the bolt 204 to rotate relative to the bolt carrier 202 and barrel from a first rotational position to a second rotational position, resulting in a relative axial and rotational movement between the bolt and bolt carrier. The rotation also results in a relative rotational movement between the bolt 204 and the breech of the rifle barrel, resulting in the lugs 206 rotating out of alignment with the recesses in the breech to thereby securely lock the bolt and the chamber together for firing the round of ammunition. In the illustrated prior art example, bolt 204 rotates 15 degrees when it rotates from the first rotational position to the second rotational position. The locked configuration of the bolt is referred to in the art as "in battery." The firing pin then slides in a forward axial direction through the firing pin bore 216 until a forward end of the firing pin strikes the primer of the cartridge to thereby fire the rifle.

During the ejection step, high temperature and pressure gases resulting from the rapid exothermic combustion of the propellent in the cartridge are utilized as a motive force to cause the bolt carrier assembly 106 to move in a rearward axial direction. Specifically, bolt carrier 202 includes a gas key 224 that engages a gas tube (not illustrated) when the bolt carrier assembly 106 is in battery. The high temperature and pressure gases are routed from the barrel through the gas tube to the gas key 224, thereby forcing the bolt carrier assembly 106 rearward. The cam pin 210 and helical groove 212 cooperate to rotate bolt 204 from the second rotational position back to the first rotational position where lugs 206 are in alignment with the recesses in the breech of the rifle barrel. Cam pin 210 then comes into contact with a forward end 226 of helical groove 212 which causes the bolt carrier 202 to pull bolt 204 in a rearward axial direction with the bolt carrier.

During the rearward movement, the casing-engaging end of the extractor 220 is coupled to the rim of the casing and is effective to extract the spent casing from the chamber. The spring-biased ejector 222 exerts a pressing force on the base of the casing which is counteracted by the wall of the chamber. When the bolt carrier group 106 has moved sufficiently rearward, the spent casing reaches the ejection port 108. At that point the wall of the chamber is no longer counteracting the pressing force of the ejector 222 and the combined effect of the pushing force of the ejector 222 on the base of the casing, the radially inward force of the extractor on the casing rim at a location on the casing that is substantially opposite the ejector, and the rapid rearward motion of the bolt carrier assembly 106 causes the casing to eject from the firearm in a rearward lateral direction at an ejection angle. The ejection angle can be described in spherical coordinates and can consist of an azimuthal angle, phi, with respect to a central longitudinal axis of the rifle barrel and a polar angle, theta, with respect to a polar axis that extends perpendicular to the central longitudinal axis of the rifle barrel. The polar angle component of the ejection angle is primarily controlled by the relative locations of the extractor 220 and ejector 222 on the bolt 204 and the rotational position and movement of the bolt during ejection. After the spent casing has been ejected, the bolt carrier assembly 106 can repeat the cycle by moving in a forward direction to load the next round of ammunition into the rifle barrel chamber.

SUMMARY OF THE DISCLOSURE

In one implementation, the present disclosure is directed to an ambidextrous firearm bolt. The ambidextrous firearm bolt includes a bolt body; first and second extractors pivotally coupled to the bolt body, each of the extractors having an ammunition casing engaging end, the casing engaging ends resiliently biased in a radially inward direction; and a selector assembly at least partially disposed in the bolt body and configured to selectively disengage one of the extractors to control a side of the bolt a spent casing is ejected from.

In another implementation, the present disclosure is directed to a system. The system includes an ambidextrous firearm bolt according to any of the preceding claims; and a selector switch configured to be coupled to a chassis or barrel extension of a firearm and operably coupled to the ambidextrous firearm bolt and configured to transition the bolt between left and right side ejection configurations.

In yet another implementation, the present disclosure is directed to a firearm. The firearm includes an ambidextrous firearm bolt according to any of the preceding claims; and a left side ejection port located on a left side of the firearm and a right side ejection port located on a right side of the firearm, the ambidextrous firearm bolt configured to eject a spent casing through either of the ejection ports.

In yet another implementation, the present disclosure is directed to a method of operating a firearm that includes an ambidextrous firearm bolt according to any of the preceding claims. The method includes while firearm is fully assembled and operable and without disassembly of the firearm, coupling to the selector assembly; and rotating the selector assembly to engage the one of the extractors what was disengaged and disengage the one of the extractors that was engaged to thereby change a side of the firearm the rifle is configured to eject spent casings from.

In yet another implementation, the present disclosure is directed to a method of modifying a firearm that includes a bolt. The method includes replacing the bolt with an ambidextrous bolt according to any of the preceding claims.

In yet another implementation, the present disclosure is directed to a firearm bolt. The firearm bolt includes a bolt body that includes an extractor recess; an extractor disposed in the extractor recess and pivotally coupled to the bolt body, an inner surface of the extractor and the extractor recess defining a cavity; and a debris shield located between the bolt body and the extractor and configured to prevent the ingress of debris into the cavity.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

Aspects of the present disclosure include ambidextrous bolt carrier assemblies that allow a user to quickly and easily change the side of the firearm from which a spent casing is ejected by application of a simple switching mechanism and without needing to dissemble the firearm. Bolts made in accordance with the present disclosure can be configured to operate with any of a wide variety of firearms known in the art, and may also be applied to new firearm designs and models. Non-limiting examples of firearms that may be modified for ambidextrous operation by incorporating bolts and bolt carrier assemblies of the present disclosure include any model and any year of manufacture of the Steyr AUG, AR-15, AR-10, or M-16, including, for example, any year of manufacture of any of the Steyr AUG models A1, AG-C, A2, A3, or A3 SF, PKM medium machine gun bullpups, firearms with open bolt configurations and fixed firing pins, including submachine guns and general purpose light, medium and heavy machine guns, and handguns with pistol slides, such as the Roni Glock submachine gun conversion. Additional examples of firearms that may be modified for ambidextrous operation with embodiments of the present disclosure include the AK-47, AK-74, FN FAL, and GLOCK.

Figure 2:
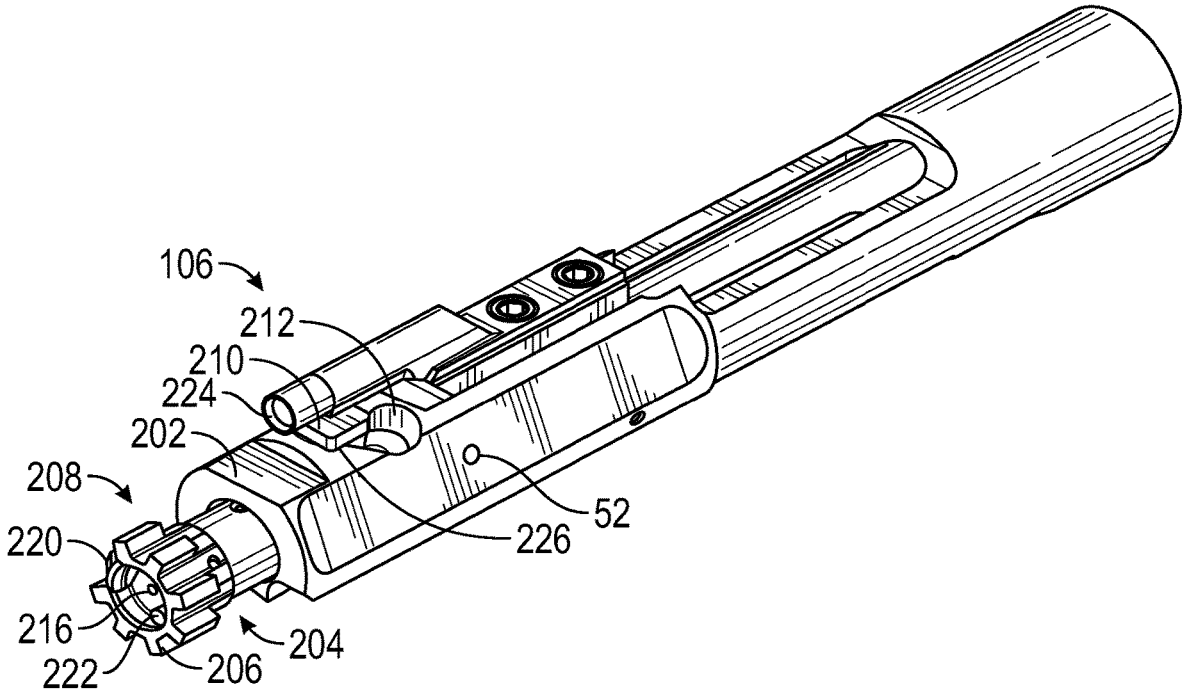
FIG. 2 (Prior Art)
FIG. 2 is an isometric view of the bolt carrier assembly of the upper receiver assembly of FIG. 1.
Figure 3:
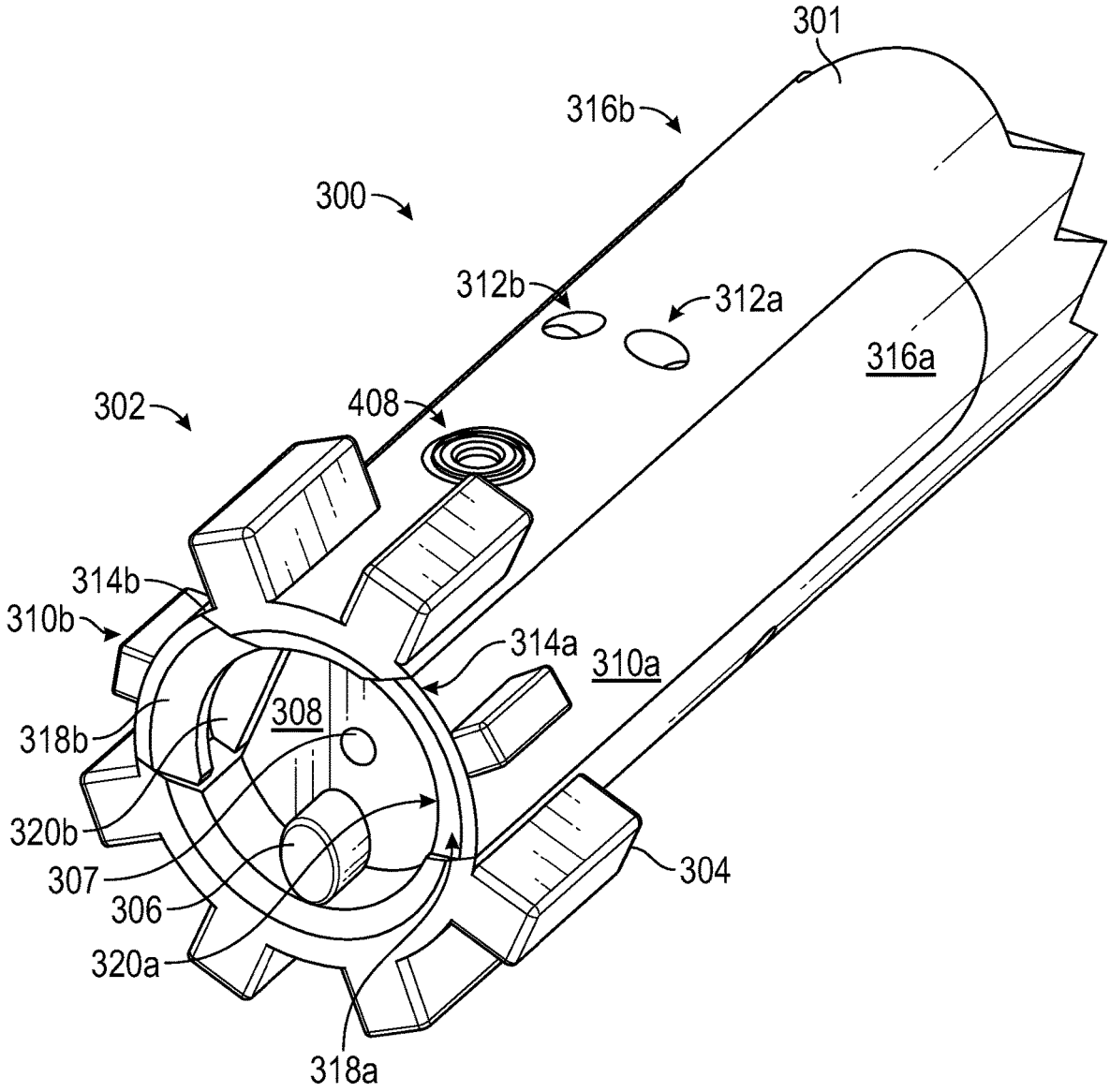
FIG. 3 is a perspective view of one example of an ambidextrous firearm bolt made in accordance with the present disclosure that includes two extractors and a single ejector.

FIG. 3 illustrates one example of an ambidextrous firearm bolt 300 made in accordance with the present disclosure. Bolt 300 is an AR-style bolt and is configured and dimensioned to be operable with prior art rifles with minimal modifications to the prior art rifle, examples of such modifications described herein. In the illustrated example, bolt 300 is designed and configured to be operable with prior art bolt carrier 202 (FIG. 2) without requiring any modification to the prior art bolt carrier and configured to be operable with upper receiver 104 with certain modifications described herein.

FIG. 3 shows a casing-engaging end 302 of bolt 300 with remaining portions including a cam pin and second opposite end of the bolt not illustrated. In the illustrated example, the bolt 300 includes a bolt body 301 that includes a plurality of radially extending circumferentially-spaced, and in this example evenly-spaced, lugs 304 (only one labeled) that are configured to engage a breech of a chamber of a rifle barrel. Bolt 300 also includes an ejector 306 that is designed to eject a spent casing from the firearm in a similar fashion as prior art ejector 222 described above. Ejector 306 is an elongate member that is slidably disposed in a complementary shaped recess located in bolt face 308. Ejector 306 is spring-biased to the extended position shown in FIG. 3 and is designed to apply a force to a base of a casing of an ammunition cartridge and eject the spent casing from the rifle. Bolt body 301 also includes a firing pin bore 307 configured for a firing pin to be disposed therein for making contact with a primer of a round of ammunition.

Unlike prior art bolt 204, which has only one extractor 220, bolt 300 has two extractors 310*a*, 310*b* that are operably coupled to opposite sides of the bolt. Extractors 310 can be alternately selected or deselected to control the side of the rifle the spent casing is ejected from and can be selected while bolt 300 is installed in the rifle and without requiring disassembly of the rifle. This selection function provides the capability to quickly and easily change the side of the rifle the casing is ejected from during use. In the illustrated example, each extractor 310 is pivotally coupled to bolt body 301 at a midpoint of the extractor at a pivot point 312*a*, 312*b*. Each extractor includes a casing-engaging front end 314*a*, 314*b* and a back end 316*a*, 316*b*. A resilient element, such as a compression spring (not illustrated) is located between each back end 316 and bolt body 301 to resiliently bias the back end in a radially outward direction. The biasing force is transferred through pivot points 312 resulting in the casing-engaging ends 314 being biased in a radially inward direction. Casing-engaging end 314 of each extractor 310 includes a flange 318*a*, 318*b* that defines a recess 320*a*, 320*b* that has a complementary shape as a rim on the end of a cartridge casing.

In the illustrated example, bolt 300 includes only one ejector 306 that is configured to operate with both extractors 310 and eject the spent casing from either side of the rifle. Ejector 306 has a larger cross-sectional area than prior art ejector 222 and has an oval-shaped cross section, the larger area and oval shape designed to increase the effectiveness of the single ejector for ejection to either side of the rifle in cooperation with either extractor 310. Unlike prior art ejector 222, ejector 306 is not located 180 degrees from either extractor 310 and is instead located at an angle from at least one extractor that is in the range of 110 degrees to 145 degrees and in some examples, in the range of 112.5 degrees to 135 degrees and in some examples, approximately 135 degrees. In the illustrated example, the angular spacing of the location of ejector 306 on bolt 300 relative to each extractor 310 is the same and is equally spaced from both extractors.

Figure 4:
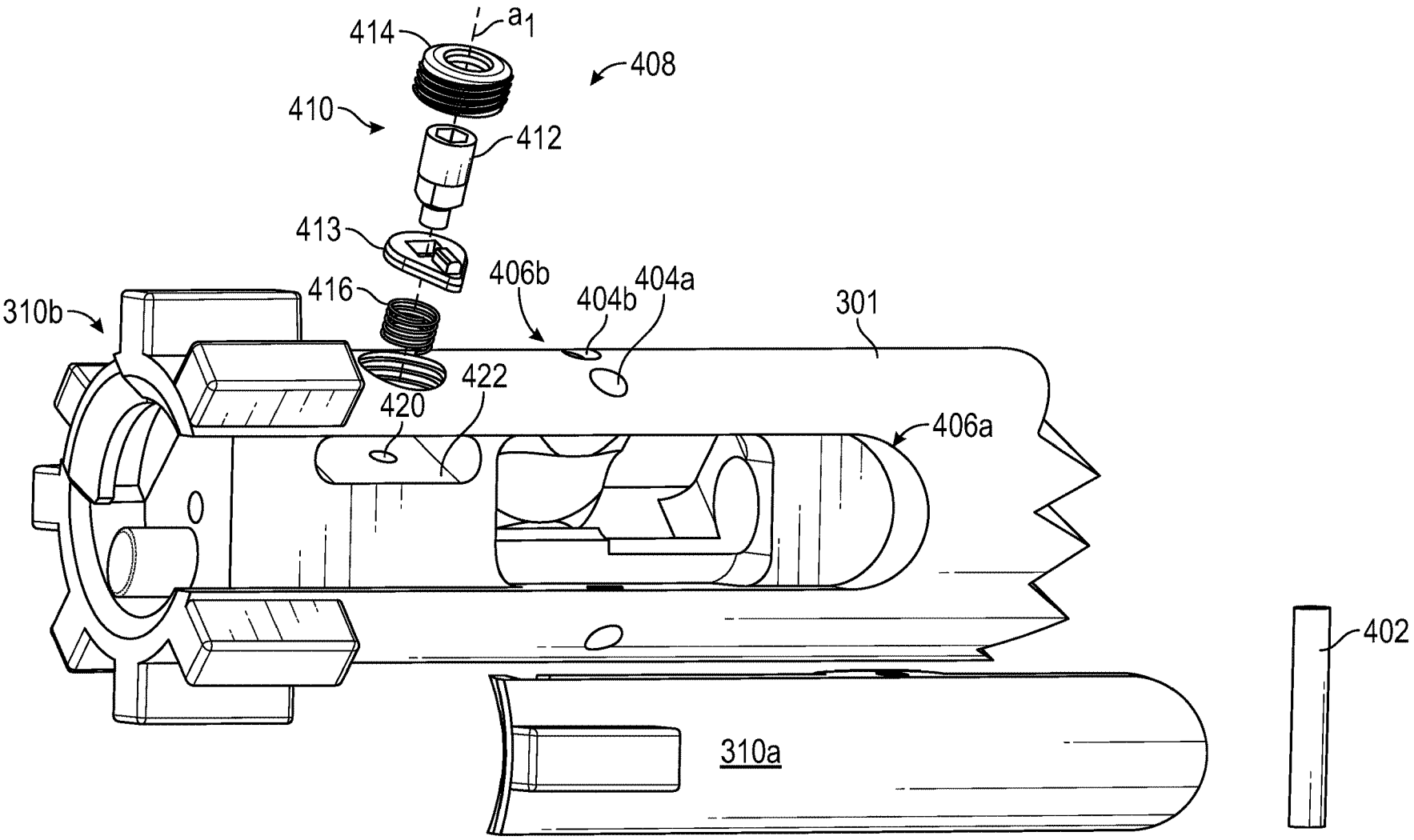
FIG. 4 is an exploded side view of the bolt of FIG. 3.

FIG. 4 is an exploded view of ambidextrous bolt 300, showing extractor 310*a* removed and illustrating the internal construction of bolt body 301. Bolt 300 includes two pivot pins 402 (only one illustrated) disposed in pivot pin recesses 404*a*, 404*b* for pivotally coupling the extractors 310 to bolt body 301. Bolt body 301 includes two extractor recesses 406*a*, 406*b*, with extractor 310*a* removed in FIG. 4 to better illustrate recess 406. Extractor recesses 406 are located on opposing sides of bolt body 301 and are configured and dimensioned to receive a corresponding extractor 310.

Bolt 300 includes a selector assembly 408 disposed in bolt body 301 and configured to selectively disengage one of extractors 310. In the illustrated example, selector assembly 408 includes an extractor cam 410 that is configured and dimensioned to selectively disengage one of the extractors 310 and couple to a turning device, such as a hex key or switch, to rotate the cam. In the illustrated example, extractor cam 410 has a two part design and includes a shaft 412 and a base 413. In other examples, extractor cam 410 may have a unitary construction having the same or similar features as shaft 412 and base 413. Selector assembly 408 also includes a bushing 414 having an inner diameter that provides a bearing surface for shaft 412 for rotatably supporting the shaft in bolt body 301, and a spring 416 for resiliently biasing extractor cam 410 in a radially-outward direction with respect to a central longitudinal axis of the bolt.

Figure 5:
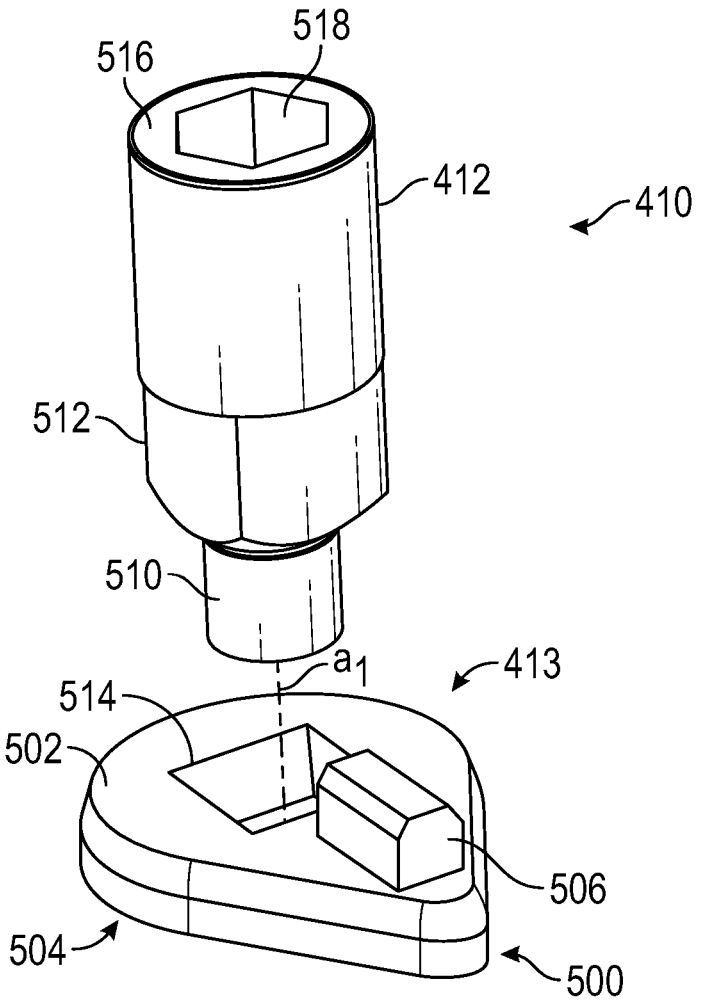
FIG. 5 illustrates a portion of a selector assembly of the bolt of FIG. 3.
Figure 6:
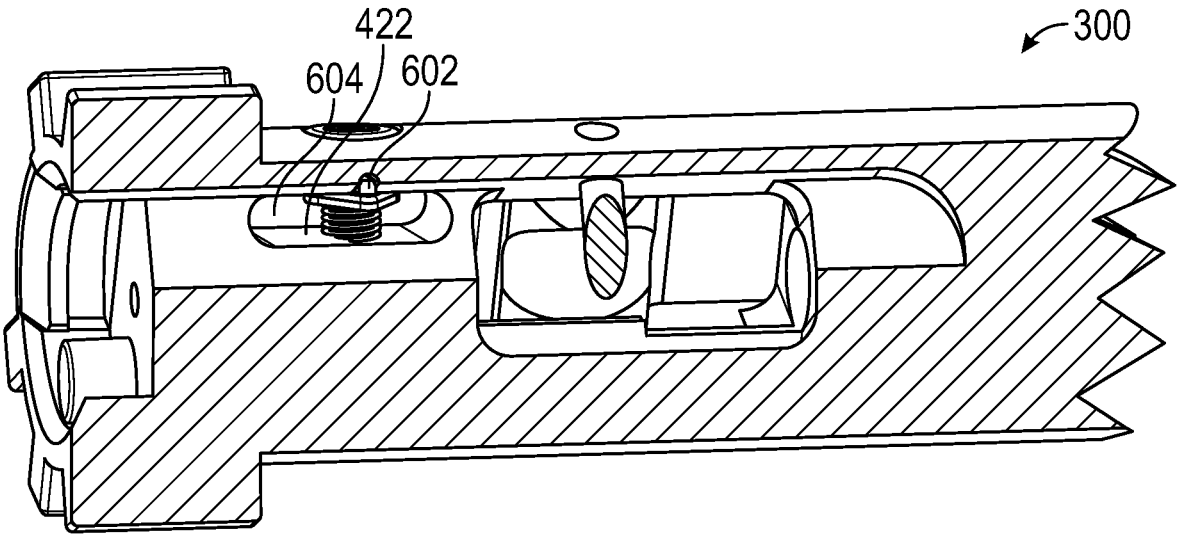
FIG. 6 is a side cross sectional view of the bolt of FIG. 3.

FIG. 5 is a perspective view of extractor cam 410 and FIG. 6 is a cross sectional view of bolt 300. Referring to FIG. 5, in the illustrated example, shaft 412 and base 413 are configured to rotate about a rotational axis a1. Extractor cam 410 includes an extractor engaging end 500 that extends laterally from rotational axis a1 to provide a cam function that converts a rotational motion of the extractor cam into a pivoting motion of one of the extractors 310 to move casing-engaging end 314 of one of extractors 310 in a radially outward motion to thereby disengage that extractor. In the illustrated example, base 413 of extractor cam 410 generally has a teardrop shape with extractor-engaging end 500 located at a vertex of the shape. More specifically, a cross-sectional shape of extractor cam 410 in a plane that is perpendicular to rotational axis a1 is generally a tear drop shape. In some examples, a shape of the extractor cam in a cam plane, where the cam plane extends through the rotational axis a1 and one of the extractors 310 is designed and configured to be offset or eccentric with respect to rotational axis a1 and provide a cam function. In other examples, extractor cams made in accordance with the present disclosure may have any of a variety of alternate shapes that are designed and configured to provide a cam function, such as a round, elliptical, rectangular or triangular shape.

In the illustrated example, base 413 of extractor cam 410 includes a top surface 502 and a bottom surface 504 and a key in the form of a raised rib 506 on the top surface that is configured to engage a key recess in the form of a slot 602 (FIG. 6) in bolt body 301, the rib and slot having complementary shapes and configured to function as a detent for maintaining extractor cam 410 in either a left or right handed position. FIG. 6 shows selector assembly 408 in a right handed position with extractor-engaging end 500 positioned on a left side of bolt 300 to thereby push out and disengage extractor 310*a*, with spring 416 pushing extractor cam 410 radially-outward so that raised rib 506 is disposed in and engaged with slot 602. To operate extractor cam 410, a turning device is used to push the extractor cam in a radially-inward direction to compress spring 416 until raised rib 506 is removed from slot 602. Extractor cam 410 can then be rotated 180 degrees to disengage the extractor on the opposite side of the bolt to thereby switch the side of ejection. When extractor cam 410 has been rotated 180 degrees spring 416 pushes the extractor cam radially outward so that raised rib 506 can reengage slot 602 on the opposite side of the bolt.

As shown in FIG. 6, the components of selector assembly 408 are rotatably disposed in a selector cavity 604 in bolt body 301, the selector cavity including a recess 420 in the base 422 (FIG. 4) of the cavity that is configured to receive a first end 510 of shaft 412 (FIG. 5) for rotatably coupling the first end of the shaft to the base of the selector cavity. In the illustrated example, shaft 412 has a base-engaging portion 512 that includes an outer wall that defines a shape that is complementary to a shape of an opening 514 that extends though a thickness of base 413 for removeably and non-rotatably coupling the shaft and the base. A second end 516 of shaft 412 includes a recess 518 configured to receive a turning device such as a hex key or a portion of a selector switch to allow a user to quickly and easily change the side of ejection by rotating the selector assembly 408. Spring 416 is positioned between base 422 of cavity 604 and extractor cam 410 and presses against bottom surface 504 of the extractor cam to press the extractor cam in a radially-outward direction with respect to a central longitudinal axis of the bolt.

Figure 1:
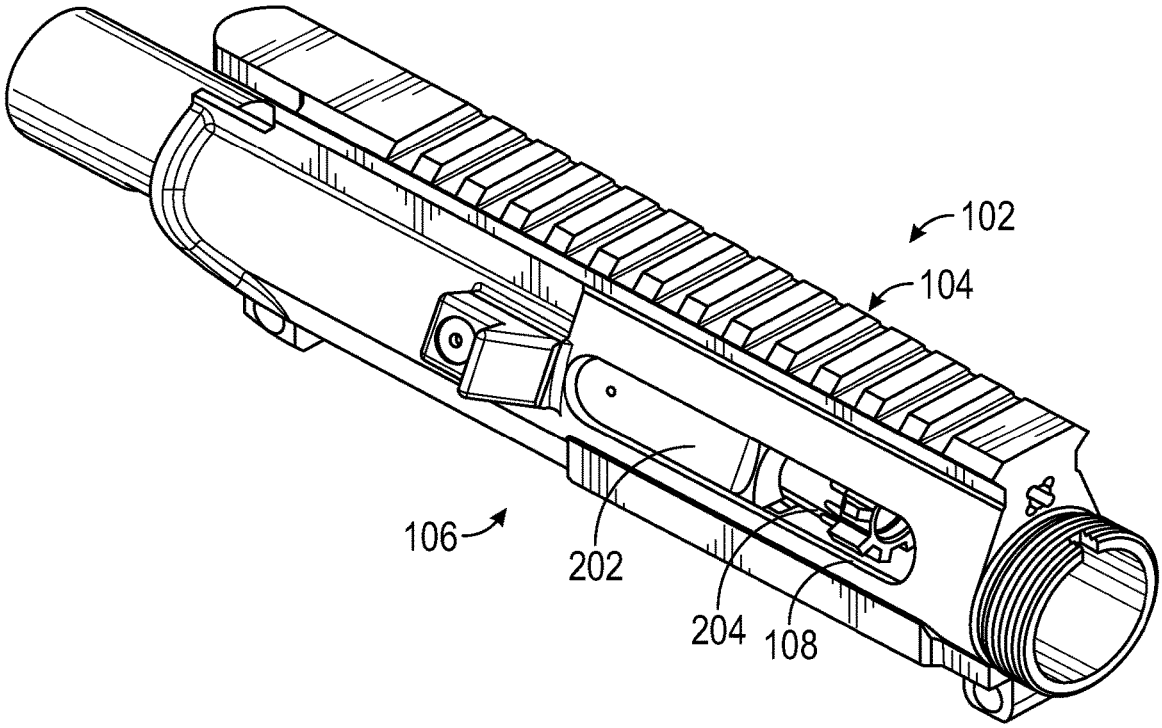
FIG. 1 (Prior Art)
FIG. 1 is an isometric view of an upper receiver assembly of a prior art AR-style rifle showing a partially retracted bolt carrier and bolt.

In the illustrated example, extractor cam 410 is accessible when the firearm is fully assembled such that the side of ejection can be changed during use without the need to disassemble the firearm. In one example, a turning device such as one of the selector knobs or switches disclosed herein (see, for example, FIGS. 16-28) is coupled to a chassis of a firearm, such as upper receiver 104 (FIG. 1) that is configured to selectively access extractor cam 410 when bolt 300 in battery. For example, the turning device and selector assembly 408 may be configured and dimensioned to be aligned when the bolt and bolt carrier are in a forward position and in battery so that a user can engage the turning device and extractor cam 410 and rotate the extractor cam when the firearm is in a fully assembled configuration. In other examples, instead of a turning device coupled to the firearm, the firearm chassis, such as the upper receiver 104 may include an opening that permits access to extractor cam 410 by a tool such as a hex key for rotating the coupler and extractor cam 410. In other examples, selector assembly 408 may be configured to be accessed and rotated when bolt 300 is in a different position other than in battery, such as in a fully rearward, extracted, out of battery position.

In some examples, firearms made in accordance with the present disclosure may include additional couplers located in a bolt carrier and/or upper receiver or chassis that are designed and configured to move relative to one another during the load-fire-reload cycle and configured to engage when the bolt and bolt carrier are in battery or in a fully retracted position so that the upper receiver coupler may be rotated by a user without disassembly of the device, where rotation of the upper receiver coupler results in rotation of the couplers located in the bolt carrier and/or bolt, thereby rotating the extractor cam.

Figure 7A:
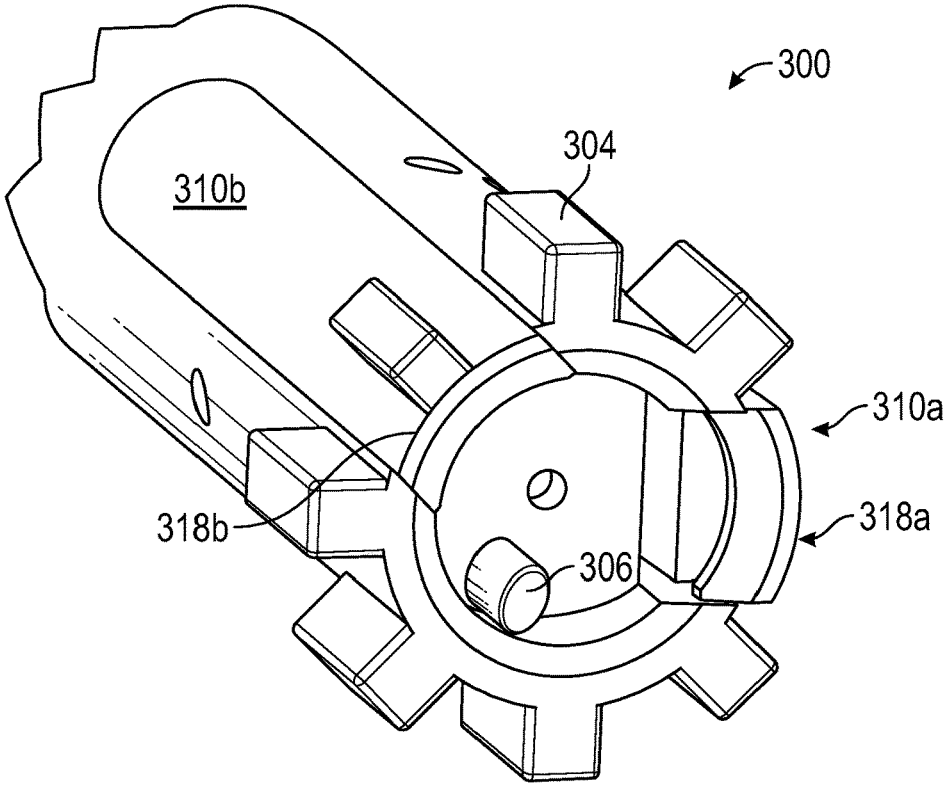
FIG. 7A is a left side perspective view of the bolt of FIG. 3 in a right side ejection configuration with the left side extractor disengaged.
Figure 7B:
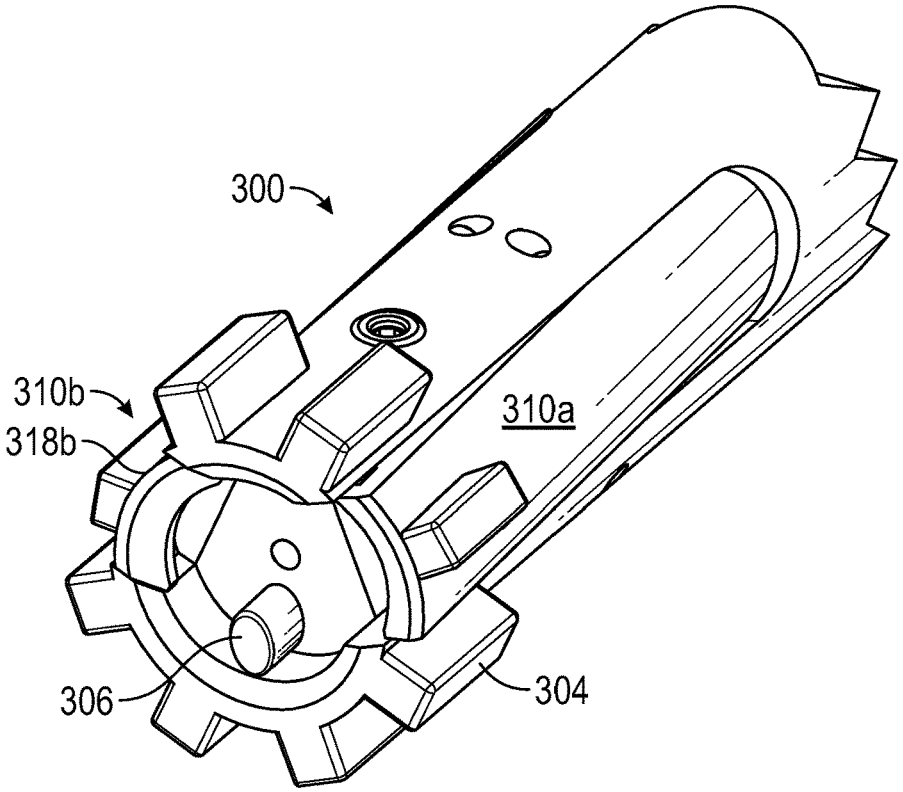
FIG. 7B is a right side perspective view of the bolt of FIG. 3 in a right side ejection configuration with the left side extractor disengaged.

FIGS. 7A and 7B illustrate bolt 300 in a right hand configuration where the bolt is configured to eject a casing to the right side of the firearm. As shown in FIGS. 7A and 7B, in the right hand position, end 314 of extractor 310*a* on the left side of bolt 300 is pushed radially outward so that the end of the extractor will not engage with an end of the casing, thereby disengaging that extractor. The other extractor 310*b* is engaged such that the end 314*b* of the extractor will engage the casing and cooperate with ejector 306 to eject the casing to the same side of the bolt as the engaged extractor 310*b*, which is to the right of bolt 300 in the illustrated configuration.

As shown in FIGS. 7A and 7B, in the illustrated example, extractors 310 are located at approximately +/−45° from a top center or 12 oclock position and ejector 306 is located at 180°, or a bottom center, or a 6 oclock position. Thus, in the illustrated example, ejector 306 is not located directly opposite either extractor 310 and is instead located approximately 135° from each extractor. In one example, bolt 300 is configured as an aftermarket replacement bolt that can be used to preplace an original equipment manufacturer (OEM) bolt. In such cases, bolt 300 and lugs 304 may be configured and dimensioned to be operable with an OEM firearm, including the recesses in the breech of the firearm barrel the lugs engage when going into the battery position for firing.

Figure 8A:
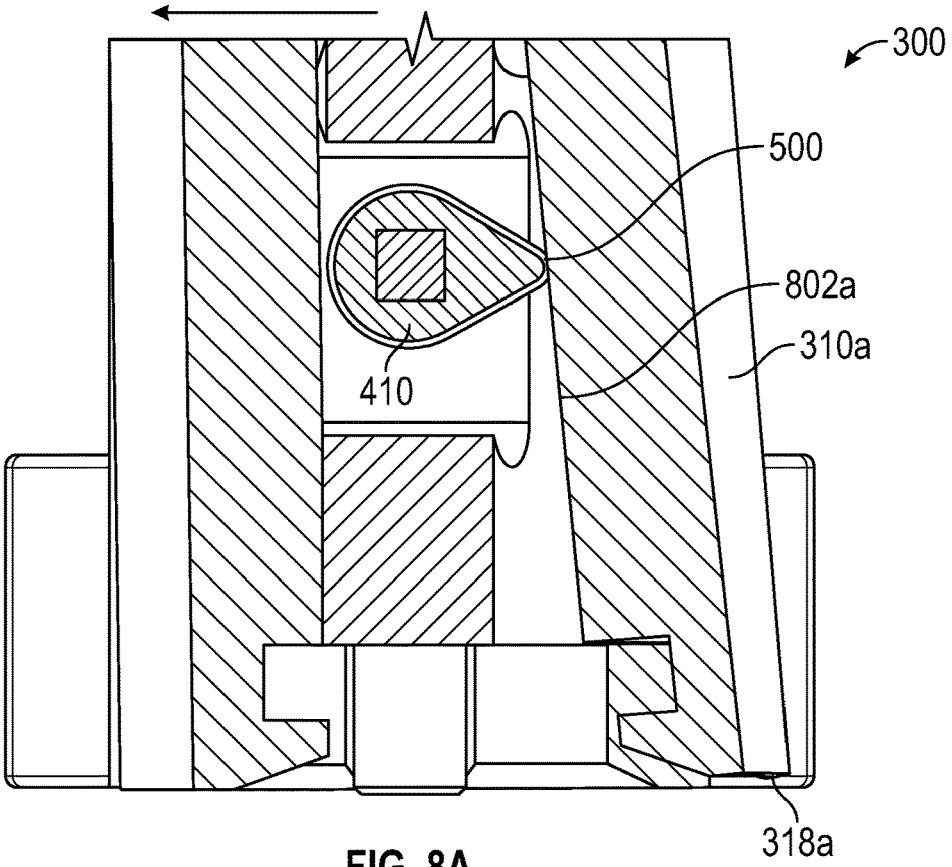
FIG. 8A is a top cross sectional view of the bolt of FIG. 3 in a right side ejection configuration with the left side extractor disengaged.
Figure 8B:
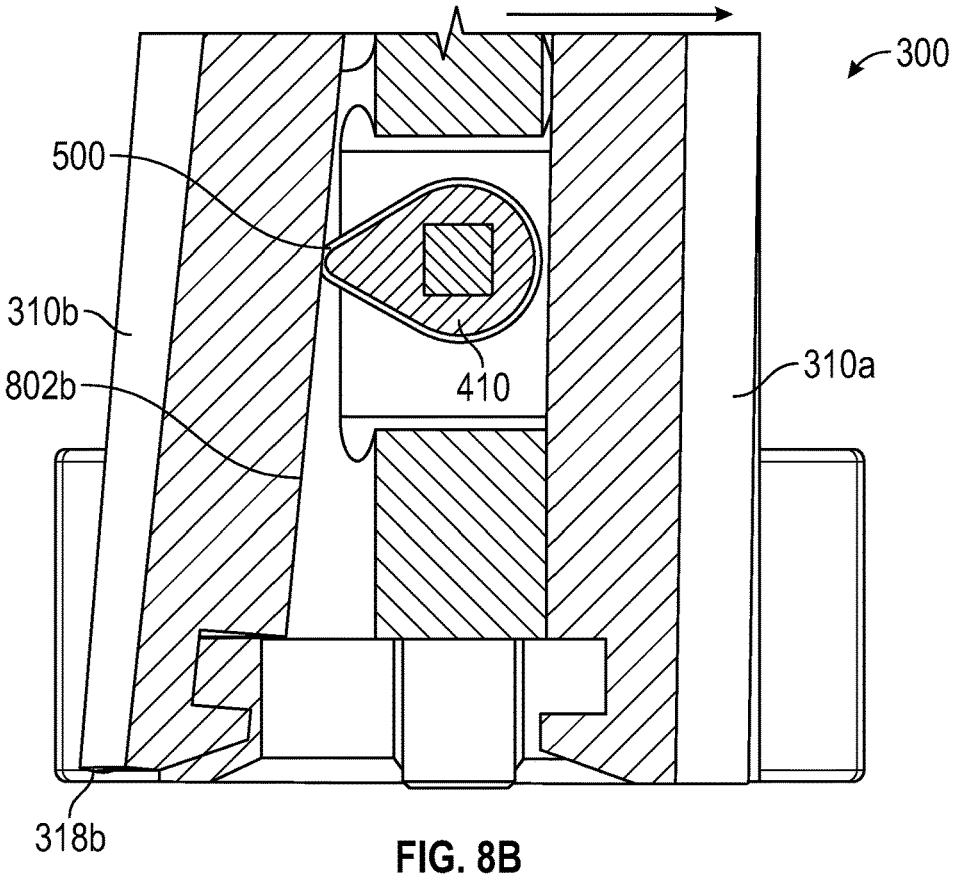
FIG. 8B is a top cross sectional view of the bolt of FIG. 3 in a left side ejection configuration with the right side extractor disengaged.

FIGS. 8A and 8B are top cross sectional views of bolt 300 that illustrate extractor cam 410 in left and right handed positions. FIG. 8A shows the right handed position, with extractor-engaging end 500 of extractor cam 410 in contact with an inner side 802*a* of extractor 310*a* on a left side of the bolt, thereby causing the extractor to pivot and the casing-engaging end 314*a* to move radially outward so that it will not engage an end of a casing during loading. FIG. 8B shows the second, left handed position, where extractor cam 410 has been rotated to engage an inner side 802*b* of extractor 310*b* on a right side of bolt 300. With extractor cam 410 changed to the left hand position, extractor 310*a* has moved radially inward due to an extractor spring that resiliently biases the casing-engaging end 314*a* of the extractor in a radially-inward direction and end 314*b* of extractor 310*b* has been moved radially outward to disengage that extractor.

Figure 9:
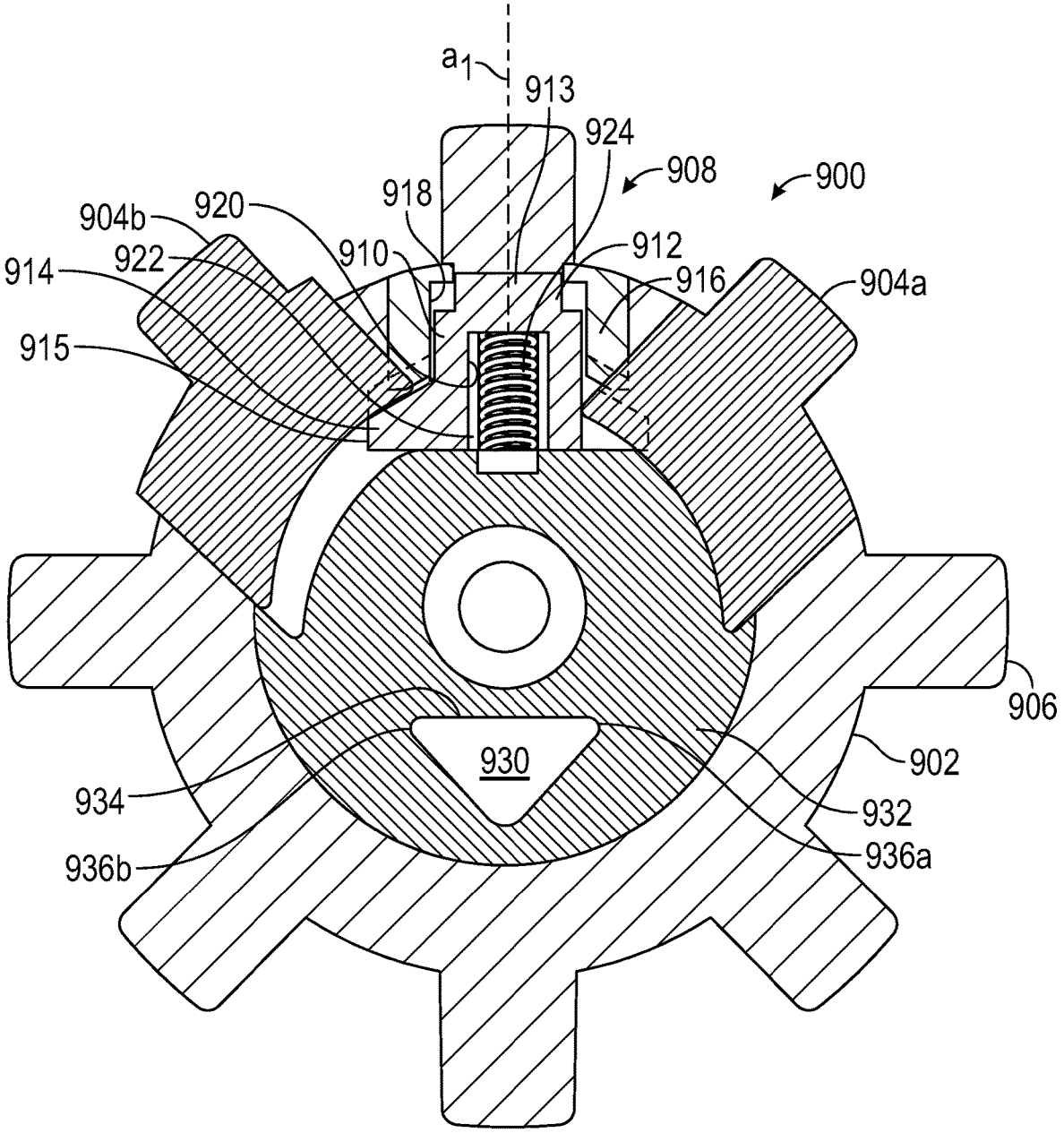
FIG. 9 is a front cross sectional view of another example of an ambidextrous firearm bolt made in accordance with the present disclosure that includes two extractors and a single ejector.

FIG. 9 is a front cross sectional view of an ambidextrous bolt 900 made in accordance with the present disclosure. The example shown in FIG. 9 is designed and configured to be installed in a Steyr Aug rifle and provide an ejection angle from either side of the rifle that has a polar angle component with respect to a polar axis that extends perpendicular to a central longitudinal axis of the rifle barrel of approximately 45 degrees. In other examples, bolts made in accordance with the present disclosure may be configured to eject spent casings at virtually any angle, according to the specific configuration and requirements for a particular rifle, including a range of upward ejection angles (between 0 degrees and 90 degrees from a vertical axis of the rifle) and downward ejection angles (between 90 degrees and 180 degrees from vertical axis of the rifle). As with bolt 300, bolt 900 has a bolt body 902 and two extractors 904*a*, 904*b* that are each pivotally coupled to the bolt body and a plurality of radially extending and circumferentially spaced lugs 906 (only one labeled). In the illustrated example, lugs 906 are evenly spaced. In other examples, the lugs of bolts made in accordance with the present disclosure may have any positioning or spacing for mating with a particular barrel extension. Bolt 900 includes a selector assembly 908 disposed in bolt body 902 and configured to selectively disengage one of extractors 904. In the illustrated example, selector assembly 908 includes an extractor cam 910 that is configured and dimensioned to selectively disengage one of the extractors 904 and couple to a turning device (not illustrated), such as a hex key or switch, to rotate the extractor cam. In the illustrated example, extractor cam 910 has a unitary construction and includes a shaft 912 and a base 914. In other examples, extractor cam 410 may be formed of two or more components that are configured to be coupled together. Shaft 912 includes a top end 913 that includes a recess or other feature (not illustrated) that is configured to couple to a turning device. Base 914 has a cam-engaging end 915 that laterally extends from a rotational axis of the selector cam that is designed and configured to come into contact with an inner side of an extractor and provide a cam function.

Selector assembly 908 also includes a bushing 916 disposed in bolt body 902 that has an inner wall 918 that provides a bearing surface for shaft 912 for rotatably supporting the shaft in bolt body 902. Extractor cam 910 has an inner wall 920 that defines a spring cavity 922 and selector assembly 908 further includes a spring 924 disposed in the spring cavity that resiliently biases the extractor cam in a radially-outward direction. As with extractor cam 410, extractor cam 910 is configured to be rotated to selectively disengage one of extractors 904. Extractor cam 910 is configured to move in a radial direction within bushing 916 between an extended position and the compressed position shown in FIG. 9. To operate extractor cam 910, a turning device (not illustrated) is used to push the extractor cam in a radially-inward direction to compress spring 924 and then rotate the extractor cam 180 degrees to disengage the extractor on the opposite side of the bolt to thereby switch the side of ejection. When extractor cam 910 has been rotated 180 degrees and the radially inward force from a turning device removed, spring 924 pushes the extractor cam radially outward to an extended position. As with extractor cam 410, extractor cam 910 may include one or more detents that are engaged when the extractor cam is in the extended radially outward position, for example, complementary protrusions and recesses on top end 913 of extractor cam 910 and inner wall of bushing 916, bolt body 902, or extractors 904.

Bolt 900 also includes a single ejector 930 that is slidably disposed in a recess in bolt face 932 and resiliently biased to an extended position for ejecting a spent casing from the firearm. As compared to prior art ejector 222, ejector 930 is oversized with a larger cross sectional area and has a triangular shape with a first edge 934 being perpendicular to a rotational axis a1 of extractor cam and two vertices 936*a*, 936*b* positioned on opposing sides of the rotational axis a1. In the illustrated example, rotational axis a1 is aligned with a radial centerline of bolt 900 and extractors 904 and ejector vertices 936 are each located on opposing sides of the centerline of the bolt. The oversized and triangular shape of ejector 930 is designed and configured to increase the effectiveness of the ejector to cooperate with either extractor 904 to eject a spent casing from either side of the firearm while minimizing a weight and moment of inertia of the ejector. In the illustrated example, extractors 904 are located at approximately +/−45° from a top center or 12 oclock position and ejector 930 is located at 180°, or a bottom center, or a 6 oclock position. Thus, in the illustrated example, ejector 930 is not located directly opposite either extractor 904 and is instead located approximately 135° from each extractor. The triangular shape of ejector 930 increases a lateral distance of an outer extent of the ejector from the bolt centerline and increases a distance between an outer extent of the ejector and an opposing extractor 904 as compared to an ejector with a circular cross section. For example, vertex 936*a* is located approximately 180 degrees from extractor 904*b* and vertex 936*b* is located approximately 180 degrees from extractor 904*a*, thereby increasing the effectiveness of the single ejector 930 to function with either extractor 904.

Figure 10:
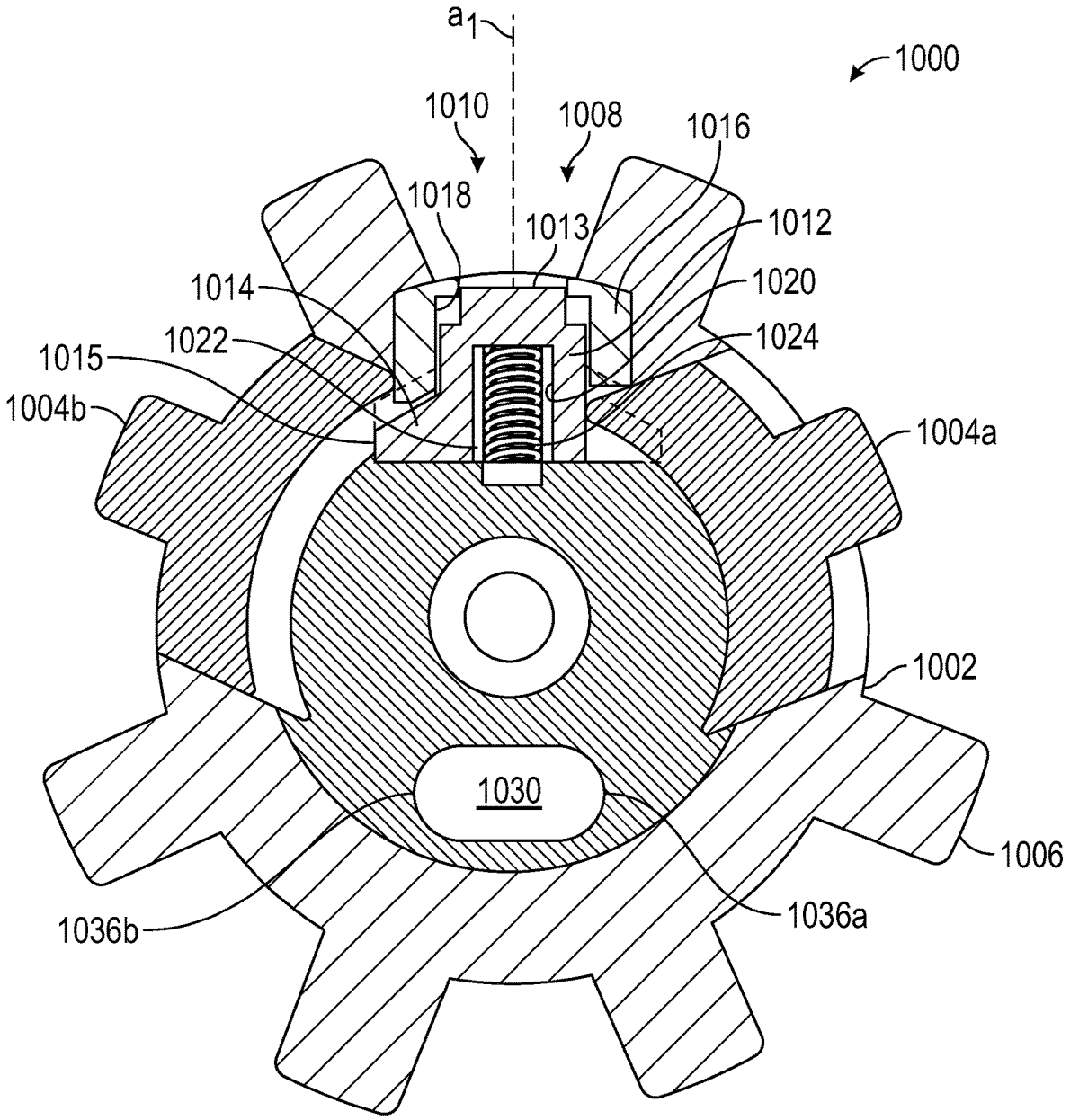
FIG. 10 is a front cross sectional view of another example of an ambidextrous firearm bolt made in accordance with the present disclosure that includes two extractors and a single ejector.

FIG. 10 is a front cross sectional view of an ambidextrous bolt 1000 made in accordance with the present disclosure. As with bolts 300 (FIG. 3) and 900 (FIG. 9), bolt 1000 has a bolt body 1002 and two extractors 1004*a*, 1004*b* that are each pivotally coupled to the bolt body and a plurality of radially extending and circumferentially spaced lugs 1006 (only one labeled). Bolt 1000 includes a selector assembly 1008 disposed in bolt body 1002 and configured to selectively disengage one of extractors 1004. In the illustrated example, selector assembly 1008 includes an extractor cam 1010 that is configured and dimensioned to selectively disengage one of the extractors 1004 and couple to a turning device (not illustrated), such as a hex key or switch, to rotate the extractor cam. In the illustrated example, extractor cam 1010 has a unitary construction and includes a shaft 1012 and a base 1014. In other examples, extractor cam 1010 may be formed of two or more components that are configured to be coupled together. Shaft 1012 includes a top end 1013 that includes a recess or other feature (not illustrated) that is configured to couple to a turning device. Base 1014 has a cam-engaging end 1015 that laterally extends from a rotational axis a1 of the selector cam that is designed and configured to come into contact with an inner side of an extractor and provide a cam function.

Selector assembly 1008 also includes a bushing 1016 disposed in bolt body 1002 that has an inner wall 1018 that provides a bearing surface for shaft 1012 for rotatably supporting the shaft in bolt body 1002. Extractor cam 1010 has an inner wall 1020 that defines a spring cavity 1022 and selector assembly 1008 further includes a spring 1024 disposed in the spring cavity that resiliently biases the extractor cam in a radially-outward direction. As with extractor cams 410 and 910, extractor cam 1010 is configured to be rotated to selectively disengage one of extractors 1004. Extractor cam 1010 is configured to move in a radial direction within bushing 1016 between an extended position and the compressed position shown in FIG. 10. To operate extractor cam 1010, a turning device (not illustrated) is used to push the extractor cam in a radially-inward direction to compress spring 1024 and then rotate the extractor cam 180 degrees to disengage the extractor on the opposite side of bolt 1000 to thereby switch the side of ejection. When extractor cam 1010 has been rotated 180 degrees and the radially inward force from a turning device removed, spring 1024 pushes the extractor cam radially outward to an extended position. As with extractor cam 410, extractor cam 1010 may include one or more detents that are engaged when the extractor cam is in the extended radially outward position, for example, complementary protrusions and recesses on top end 1013 of extractor cam 1010, inner wall of bushing 1016, or extractors 1004.

Bolt 1000 also includes a single ejector 1030 that is slidably disposed in a recess in bolt face 1032 and resiliently biased to an extended position for ejecting a spent casing from the firearm. As compared to prior art ejector 222, ejector 1030 is oversized with a larger cross sectional area and has an elliptical shape with a major axis of the ellipse being perpendicular to a rotational axis a1 of extractor cam and two ends 1036*a*, 1036*b* positioned on opposing sides of the rotational axis a1. In the illustrated example, rotational axis a1 is aligned with a radial centerline of bolt 1000 and extractors 1004 and ejector ends 1036 are each located on opposing sides of the centerline of the bolt. The oversized and elliptical shape of ejector 1030 is designed and configured to increase the effectiveness of the ejector to cooperate with either extractor 1004 to eject a spent casing from either side of the firearm while minimizing a weight and moment of inertia of the ejector. In the illustrated example, extractors 1004 are located at approximately 67.5 degrees from a top center or 12 oclock position and ejector 1030 is located at 180°, or a bottom center, or a 6 oclock position. Thus, in the illustrated example, ejector 1030 is not located directly opposite either extractor 1004 and is instead located approximately 112.5° from each extractor. The oval or elliptical shape of ejector 1030 increases a lateral distance of an outer extent of the ejector from bolt centerline a1 and increases a distance between an outer extent of the ejector and an opposing extractor 1004 as compared to an ejector with a circular cross section. For example, end 1036*a* is located at an angle of approximately 145 degrees+/−15 degrees from extractor 1004*b* and in some examples in a range of approximately 140 degrees to approximately 190 degrees from extractor 1004*b*. End 1036*b* can similarly be located approximately 145 degrees+/−15 degrees from extractor 1004*a*, and in some examples in a range of approximately 140 degrees to approximately 190 degrees from extractor 1004*b*. The oval shape thereby increasing the effectiveness of the single ejector 1030 to function with either extractor 1004.

Figure 11:
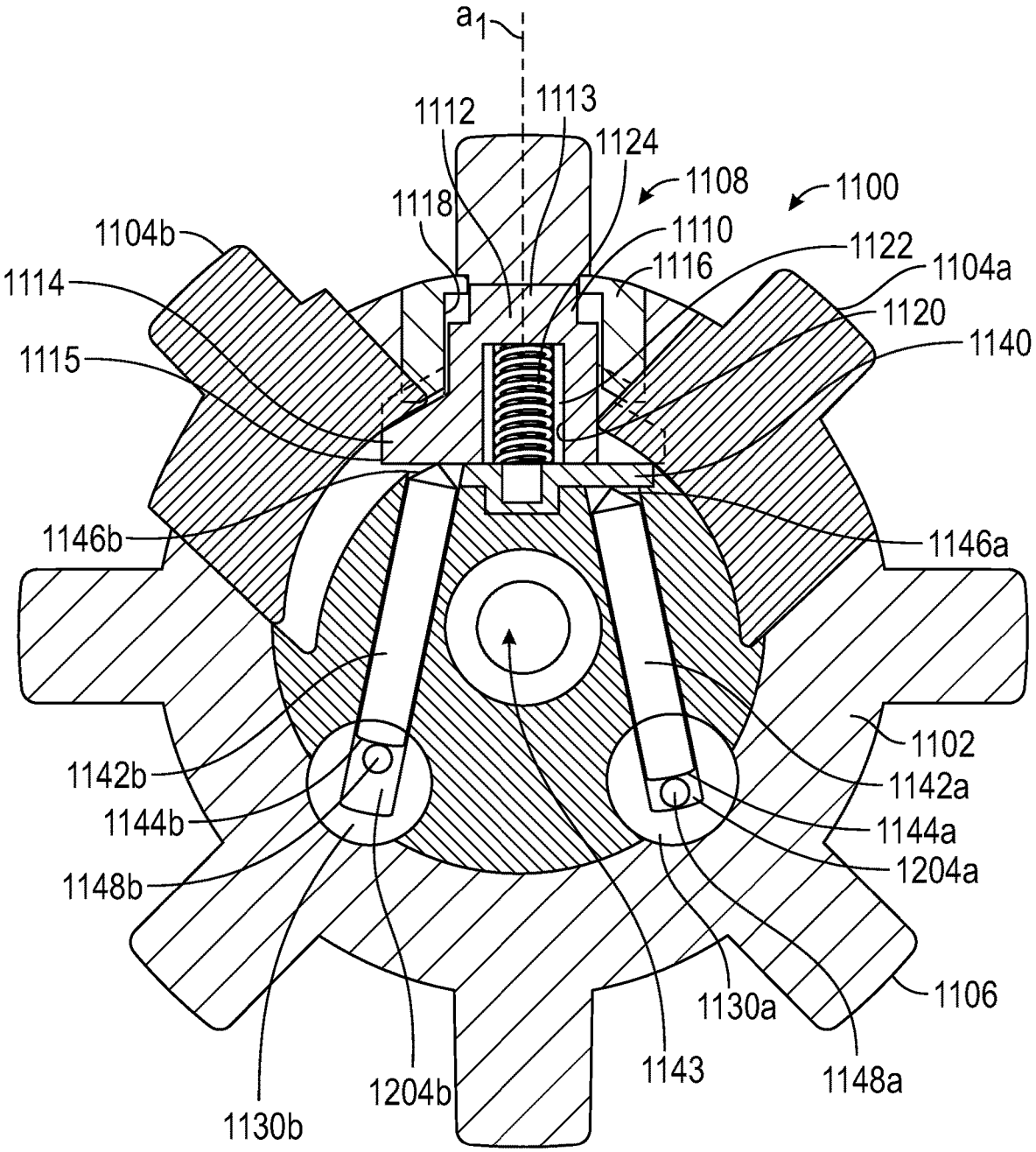
FIG. 11 is a front cross sectional view of another example of an ambidextrous firearm bolt made in accordance with the present disclosure that includes two extractors and two ejectors.

FIG. 11 is a front cross sectional view of an ambidextrous bolt 1100 made in accordance with the present disclosure. As with bolts 300 (FIG. 3), 900 (FIG. 9), and 1000 (FIG. 10), bolt 1100 has a bolt body 1102 and two extractors 1104*a*, 1104*b* that are each pivotally coupled to the bolt body and a plurality of radially extending and circumferentially spaced lugs 1106 (only one labeled). Bolt 1100 includes a selector assembly 1108 disposed in bolt body 1102 and configured to selectively disengage one of extractors 1104. In the illustrated example, selector assembly 1108 includes an extractor cam 1110 that is configured and dimensioned to selectively disengage one of the extractors 1104 and couple to a turning device (not illustrated), such as a hex key or switch, to rotate the extractor cam. In the illustrated example, extractor cam 1110 has a unitary construction and includes a shaft 1112 and a base 1114. In other examples, extractor cam 1110 may be formed of two or more components that are configured to be coupled together. Shaft 1112 includes a top end 1113 that includes a recess or other feature (not illustrated) that is configured to couple to a turning device. Base 1114 has a cam-engaging end 1115 that laterally extends from a rotational axis a1 of the selector cam that is designed and configured to come into contact with an inner side of an extractor 1104 and provide a cam function.

Selector assembly 1108 also includes a bushing 1116 disposed in bolt body 1102 that has an inner wall 1118 that provides a bearing surface for shaft 1112 for rotatably supporting the shaft in bolt body 1102. Extractor cam 1110 has an inner wall 1120 that defines a spring cavity 1122 and selector assembly 1108 further includes a spring 1124 disposed in the spring cavity that resiliently biases the extractor cam in a radially-outward direction. As with extractor cams 410, 910, and 1010, extractor cam 1110 is configured to be rotated to selectively disengage one of extractors 1104. Extractor cam 1110 is configured to move in a radial direction within bushing 1116 between an extended position and the compressed position shown in FIG. 11. To operate extractor cam 1110, a turning device (not illustrated) is used to push the extractor cam in a radially-inward direction to compress spring 1124 and then rotate the extractor cam 180 degrees to disengage the extractor on the opposite side of bolt 1100 to thereby switch the side of ejection. When extractor cam 1110 has been rotated 180 degrees and the radially inward force from a turning device removed, spring 1124 pushes the extractor cam radially outward to an extended position. As with extractor cam 410, extractor cam 1110 may include one or more detents that are engaged when the extractor cam is in the extended radially outward position, for example, complementary protrusions and recesses on top end 1113 of extractor cam 1110, inner wall of bushing 1116, or extractors 1104.

Unlike ambidextrous bolts 300, 900, and 1000, ambidextrous bolt 1100 has two ejectors 1130*a* and 1130*b* rather than one, wherein each ejector is configured to be selectively and alternately engaged according to a selected side of ejection. In the illustrated example, selector assembly 1108 is configured to simultaneously disengage one of extractors 1104 and engage the one of ejectors 1130 that is located on the same side of bolt 1100 as the disengaged extractor and an opposing side of the bolt from the engaged extractor. In the configuration shown in FIG. 11, extractor cam 1110 is positioned to the left and is pressing extractor 1104*b* out to thereby disengage the extractor. In the position shown in FIG. 11 selector assembly 1108 has engaged ejector 1130*b* and disengaged ejector 1130*a* so that extractor 1104*a* and ejector 1130*b* are engaged for ejecting a spent casing to the left side of the firearm. FIG. 11 shows extractor cam 1110 in a depressed position. After a turning device (not illustrated) is removed, extractor cam 1110 will move to a radially outward position, pressing extractor 1104*b* further radially outward to disengage it.

In the illustrated example, to accomplish the ejector selection function, selector assembly 1108 further includes an ejector cam 1140 and two locking pins 1142*a*, 1142*b* located on opposing sides of firing pin bore 1143. Each locking pin 1142 includes a first end 1144*a*, 1144*b* that is configured to be slidably disposed in a corresponding recess in one of ejectors 1130 and a second end 1146*a*, 1146*b* that is configured to engage ejector cam 1140. Each locking pin 1142 cooperates with ejector cam 1140 and one of ejectors 1130 to function as a detent that locks or unlocks the ejector according to a rotational position of selector assembly 1108. Each ejector 1130 also includes a spring 1148*a*, 1148*b* that resiliently biases the corresponding locking pin 1142 to an unlocked position.

Figure 12:
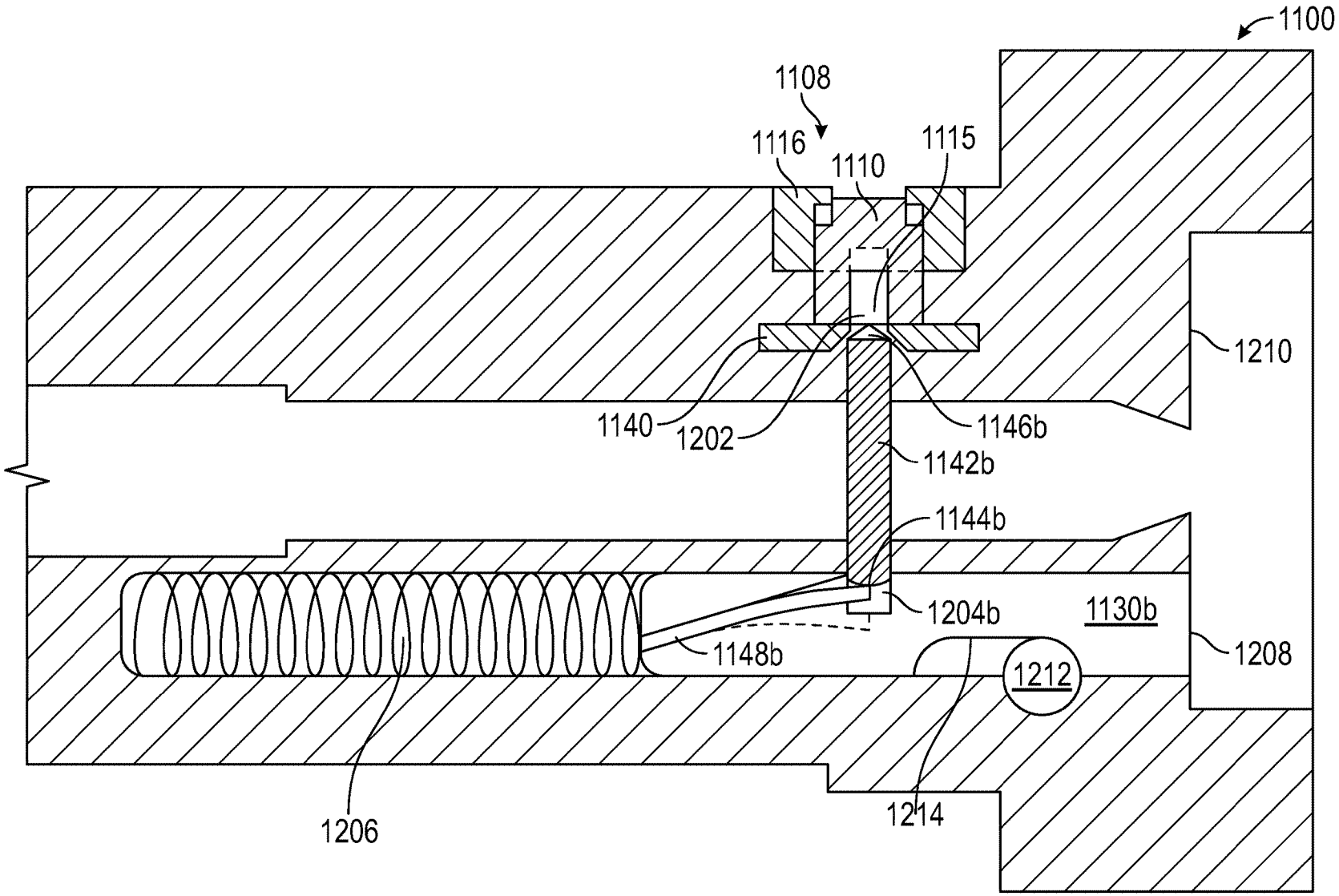
FIG. 12 is a side cross sectional view of the bolt of FIG. 11.

FIG. 12 is a right side cross sectional view of ambidextrous bolt 1100 and further illustrates selector assembly 1108. FIG. 12 shows extractor cam 1110 rotated to the same position as in FIG. 11 to a right side of bolt 1100 with extractor engaging end 1115 facing to the right. In the illustrated position, a locking pin opening 1202 in ejector cam 1140 is also rotated to the right side of bolt 1100 and aligned with locking pin 1142*b*, resulting in spring 1148*b* moving locking pin 1142*b* in an upward direction to insert second end 1146*b* into locking pin opening 1202. The upward sliding movement of locking pin 1142*b* also causes first end 1144*b* of the locking pin to be removed from a locking pin recess 1204 located in ejector 1130*b* to thereby unlock and engage ejector 1130*b*. FIG. 12 shows extractor cam 1110 in an inserted position, which also presses down locking pin 1142*b*, causing first end 1144*b* to still be partially inserted into locking pin recess 1204 of ejector 1130*b*. After the radially inward force from a turning device (not illustrated) is removed from extractor cam 1110, the force of spring 1124 (FIG. 11) and spring 1148*b* are effective to move extractor cam 1110 and locking pin 1142*b* generally in a vertical direction (relative to the illustrated orientation of FIG. 12) and generally towards bushing 116 to a fully extended position, which results in first end 1144*b* of locking pin 1142*b* being fully removed from locking pin recess 1204 which unlocks and releases ejector 1130*b* so that it is engaged and fully functional to eject spent casings. With locking pin 1142*b* removed from ejector 1130*b*, ejector 1130*b* is unlocked and ejector spring 1206 forces casing engaging end 1208 of the ejector to extend from bolt face 1210 to an extended position, the forward and rearward axial movement of the ejector limited by a roll pin 1212 and roll pin recess 1214.

Referring again to FIG. 11, with extractor cam 1110 and ejector cam 1140 rotated to the right side of bolt 1100, locking pin 1142*a* on the left side of the bolt is pressed down by the ejector cam so that first end 1144*a* of the locking pin is inserted into a locking pin recess 1204*a* in ejector 1130*a*, thereby locking the ejector in a recessed position and disengaging the ejector. Selector assembly 1108 is, therefore, effective to simultaneously and selectively engage one of extractors 1104 and a corresponding one of ejectors 1130, and selectively disengage the other one of the extractors and ejectors, the engaged extractor and ejector being located on opposite sides of bolt 1100 and located on opposite sides of a radial centerline of the bolt, and located on opposite sides of a rotational axis a1 of the selector assembly.

Figure 13A:
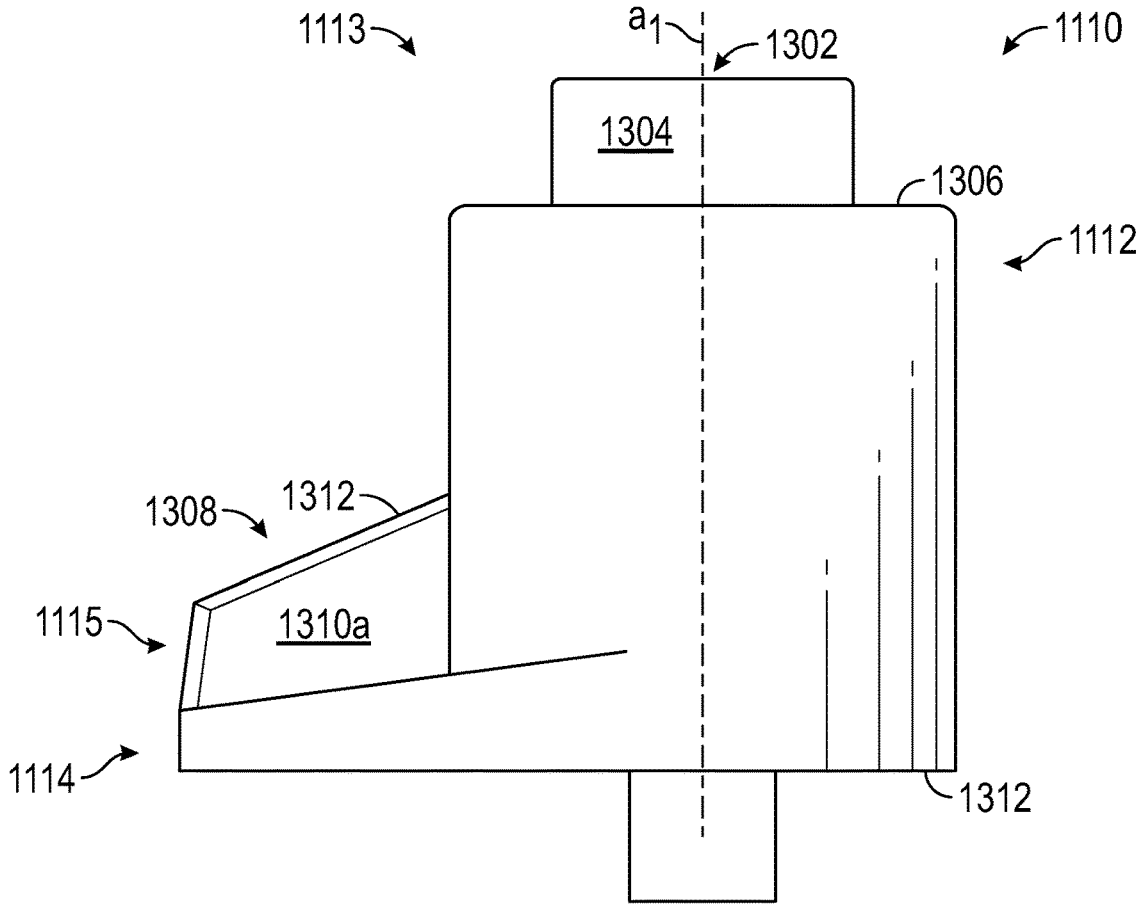
FIG. 13A is a side view of the extractor cam of the bolt of FIG. 11.
Figure 13B:
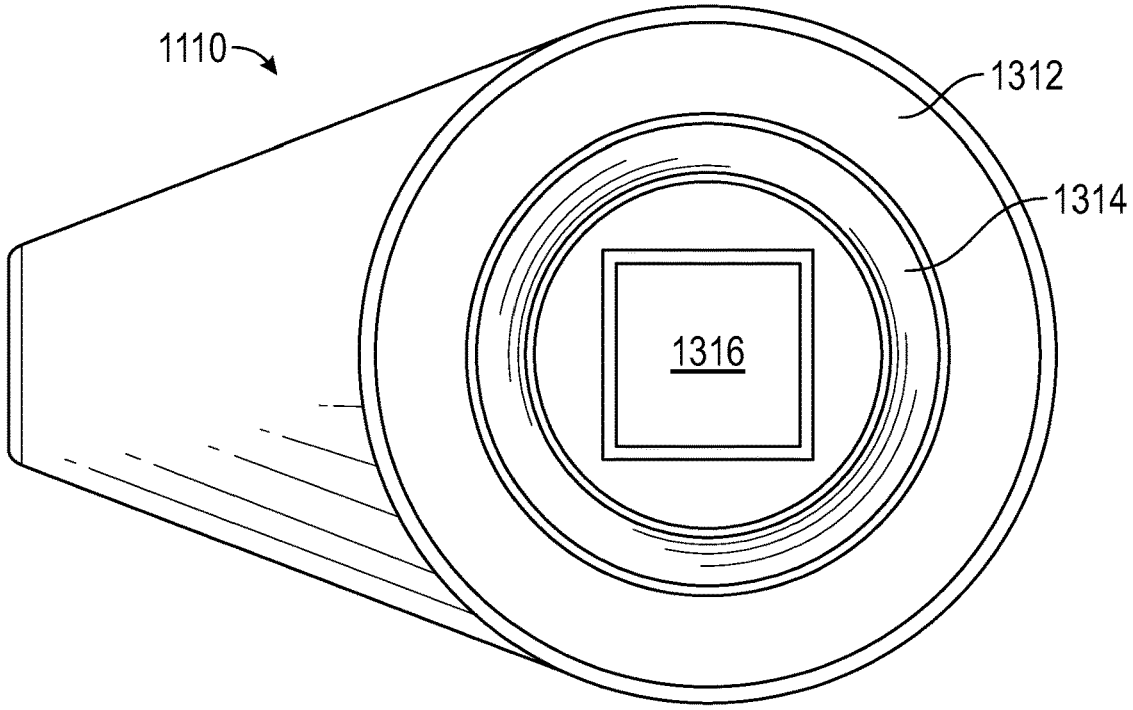
FIG. 13B is a bottom view of the extractor cam of FIG. 13A.
Figure 13C:
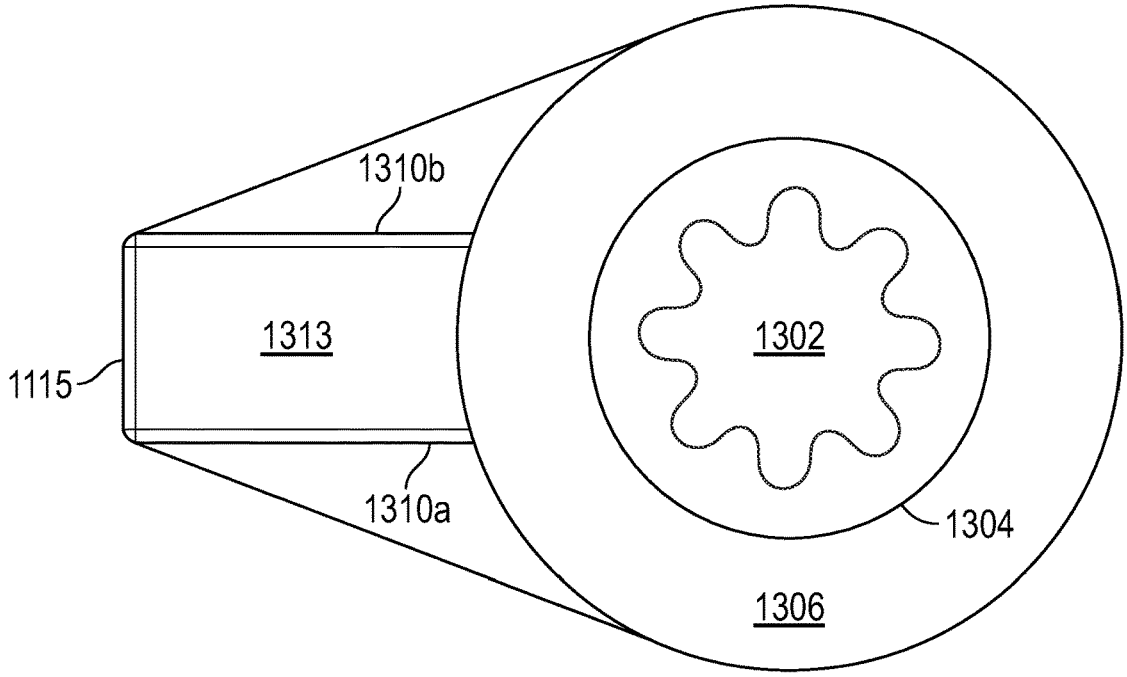
FIG. 13C is a top view of the extractor cam of FIG. 13A.

FIGS. 13A-13E further illustrate extractor cam 1110 and ejector cam 1140. FIG. 13A is a side view of extractor cam 1110, FIG. 13B is a bottom view of the extractor cam, and 13C is a top view of the extractor cam. Referring to FIGS. 13A-13C, in the illustrated example, top end 1113 of extractor cam 1110 includes a female recess 1302 having a shape that is designed to couple to a turning device, such as a kex or torx key, or any other shape. Top end 1113 has a reduced diameter portion 1304 as compared to a lower portion of shaft 1112 that defines a shelf 1306. Reduced diameter portion 1304 is configured to be slidably disposed in a correspondingly sized opening in bushing 1116 and shelf 1306 is configured to come into contact with a wall in the bushing when extractor cam 1110 is in a fully extended position and engaged in a left or right side ejection position. Extractor engaging end 1115 of base 1114 includes a key 1308 that extends vertically from base 1114 and laterally from shaft 1112 that is configured and dimensioned to engage a key recess in bushing 1116, bolt body 1102, and/or an inner side of an extractor and function as a detent and lock the extractor cam 1110 in a left or right ejection position. In the illustrated example, key 1308 has opposing sides 1310*a*, 1310*b* that are substantially perpendicular to a bottom surface 1312 of extractor cam and substantially parallel to rotational axis a1 of the extractor cam. Key 1308 also includes a top side 1313 that extends at an oblique angle to bottom surface 1312 and rotational axis a1. In other examples, key 1308 can have any of a variety of other shapes and in yet other examples, extractor cam 1110 may include a key recess and bushing 1116, bolt body 1102, and/or an inner side of an extractor may include a complementary shaped key for locking the extractor cam in the left or right side positions.

Figure 13D:
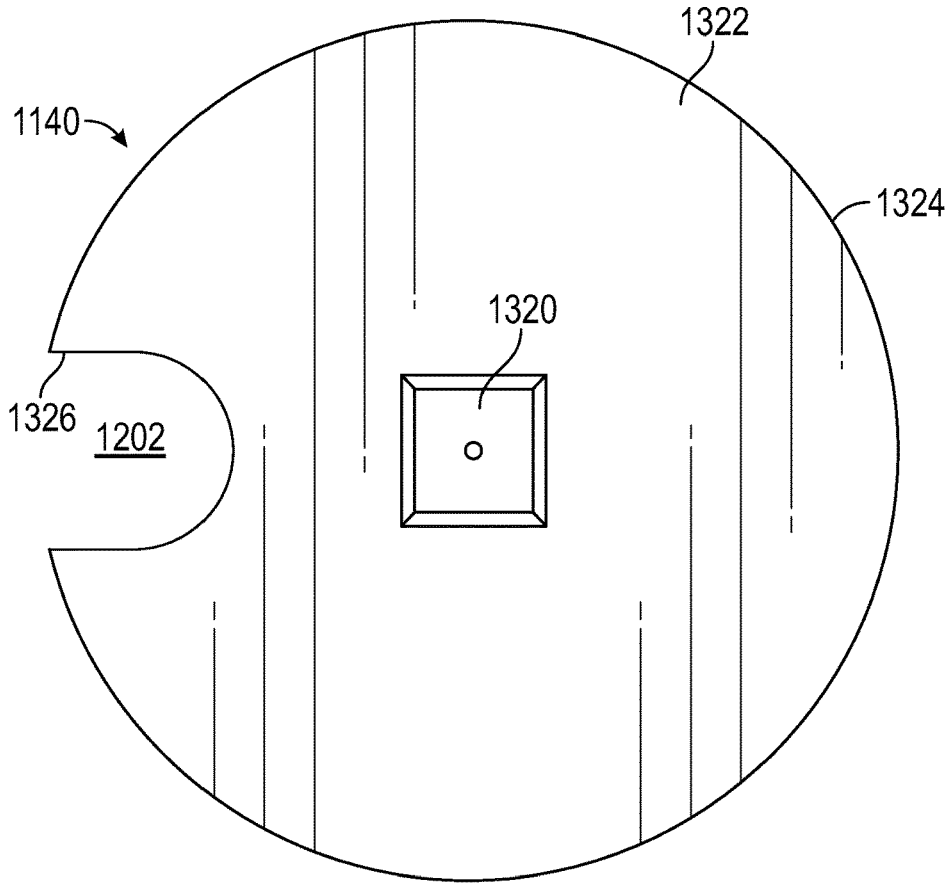
FIG. 13D is a top view of the ejector cam of the bolt of FIG. 11.
Figure 13E:
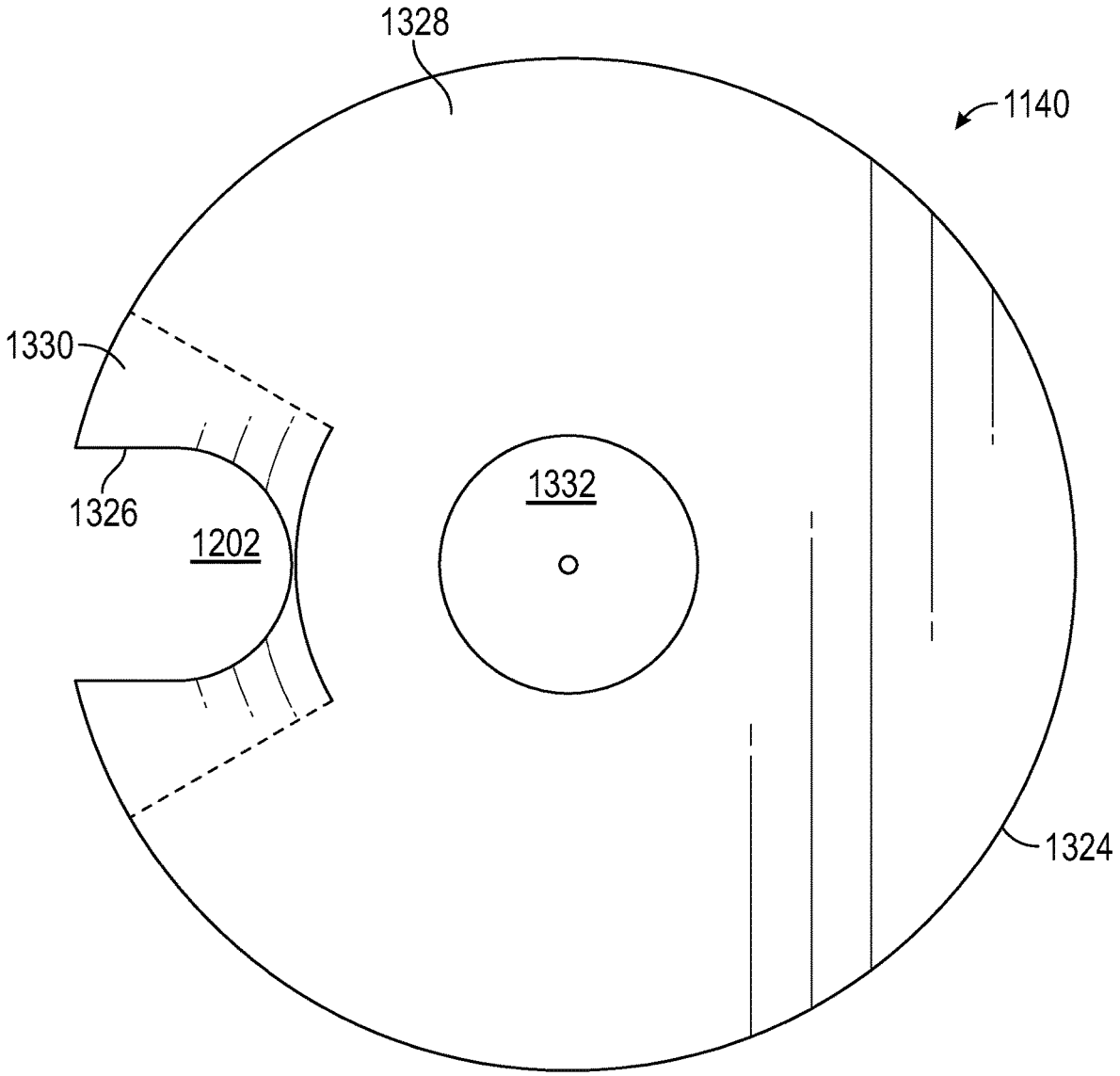
FIG. 13E is a bottom view of the ejector cam of FIG. 13D.

Referring to FIG. 13B, base 1114 includes an annular spring recess 1314, spring 1124 (FIG. 11) configured to be disposed in the recess, and a protrusion 1316 configured to extend into a complementary shaped recess 1320 on a top side 1322 of ejector cam 1140 (FIG. 13D) to non-rotatably couple the extractor and ejector cams. FIG. 13D is a top view of ejector cam 1140 and FIG. 13E is a bottom view of the ejector cam. As shown in FIGS. 13D and 13E, ejector cam 1140 generally has a circular disc shape with a circular side wall 1324. Side wall 1324 also includes a recess 1326 that defines locking pin opening 1202 (see also FIG. 12). Locking pin opening 1202 is configured and dimensioned to receive second end 1146 of locking pins 1142 when the locking pin is in an unlocked position and the corresponding ejector 1130 is engaged. Referring to FIG. 13E, a bottom side 1328 of ejector cam 1140 includes a tapered surface 1330 that facilitates the engagement and disengagement of one of the second ends 1146 of the locking pins 1142 with the locking pin recess 1202. Bottom side 1328 also includes a cylindrical extension 1332 that is configured and dimensioned to be disposed in a complementary shaped recess in bolt body 1102 to rotatably couple the ejector cam to the bolt body. In the illustrated example, extractor cam 1110 and ejector cam 1140 are a two-part assembly that is configured to be removeably and non-rotatably coupled when installed in bolt body 1102. In other examples, rather than a two part construction, a unitary member that is designed and configured to provide the extractor and ejector cam functions may be utilized.

Figure 14A:
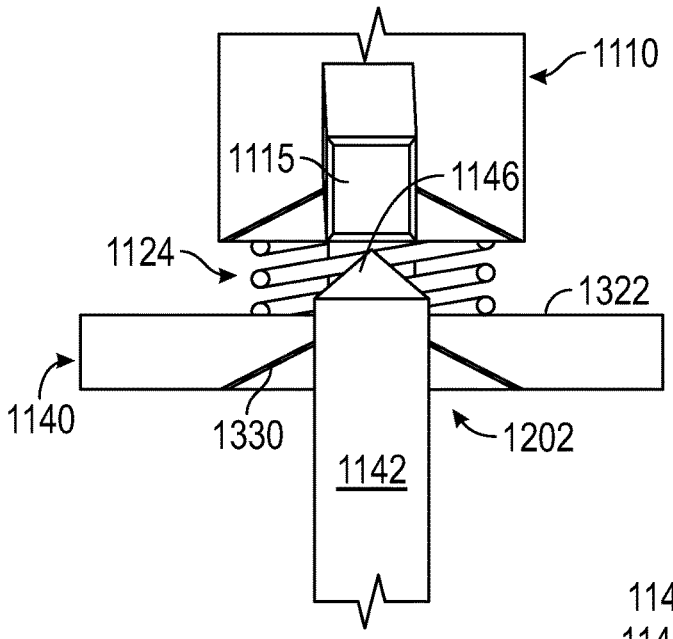
FIGS. 14A-14D illustrate the selector assembly of the bolt of FIG. 11 in various positions when the assembly is first depressed and rotated to change the side of ejection of a spent casing.
Figure 14B:
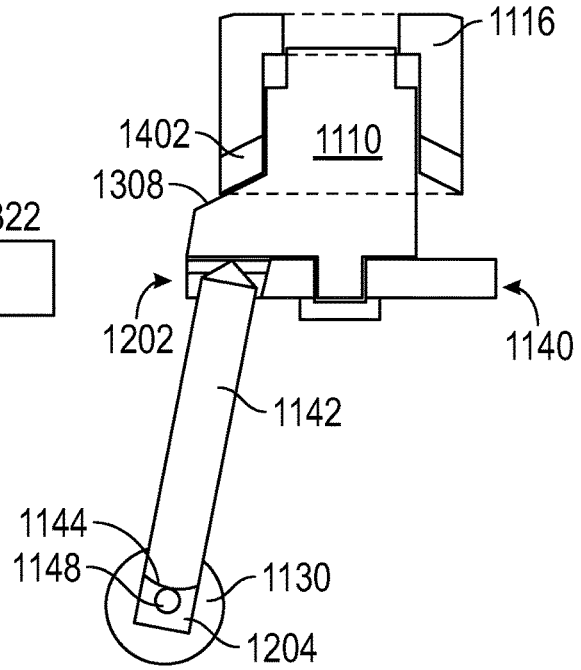
Figure 14C:
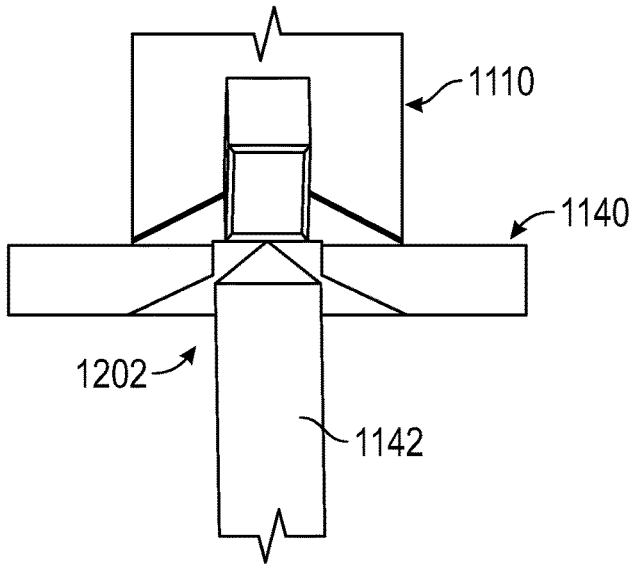
Figure 14D:
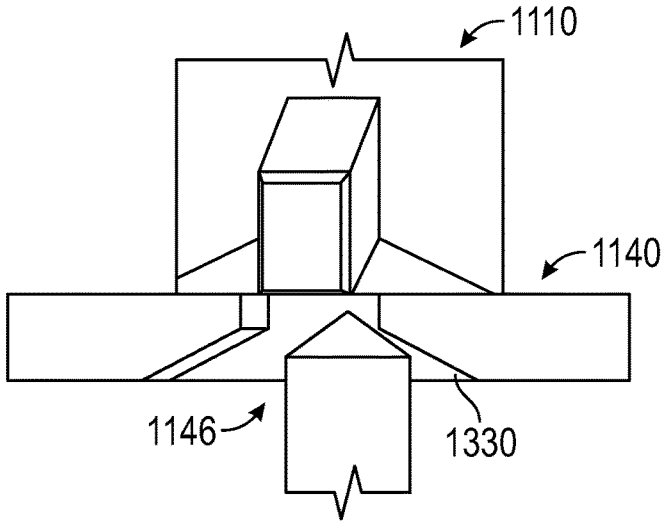

FIGS. 14A-14D further illustrate extractor cam 1110 and ejector cam 1140 and illustrate the operation of the selector assembly 1108 in the initial steps of changing the side of ejection. FIG. 14A shows the assembly in a locked configuration for either a right or left side ejection. In the locked configuration, spring 1124 and spring 1148 are pressing the assembly into the extended position, with extractor cam 1110 moved radially outward and fully engaged with bushing 1116. Locking pin 1142 is positioned in locking pin opening 1202 with the tapered second end 1146 of the locking pin fully inserted and positioned radially outward and standing proud of top side 1322 of the ejector cam 1140. In FIGS. 14B and 14C, a turning device (not illustrated) has been used to press the extractor cam 1110 and locking pin 1142 down in a radially inward direction. The radially inward movement disengages key 1308 from key recess 1402 and causes base 1114 of the extractor cam to press the locking pin 1142 down so that tapered end 1146 of the locking pin is now adjacent to tapered surface 1330 of the extractor cam. In the unlocked pressed down position, the selector assembly 1108 can be rotated to change the side of ejection. FIG. 14D illustrates the assembly after a few degrees of rotation. As shown in FIG. 14D, tapered surface 1330 engages tapered end 1146 of the locking pin 1142 which transfers the rotational movement of the ejector cam 1140 into a linear movement of the locking pin, resulting in the first end 1144 of the locking pin being inserted into the locking pin recess 1204 in the ejector 1130 to lock the ejector in place and disengage the ejector. In the illustrated example, the ejector must be in a recessed position, for example, with the bolt in battery and a cartridge loaded in the chamber, so that the first end of the locking pin is aligned with the ejector to thereby lock the ejector in the recessed position.

Figure 15:
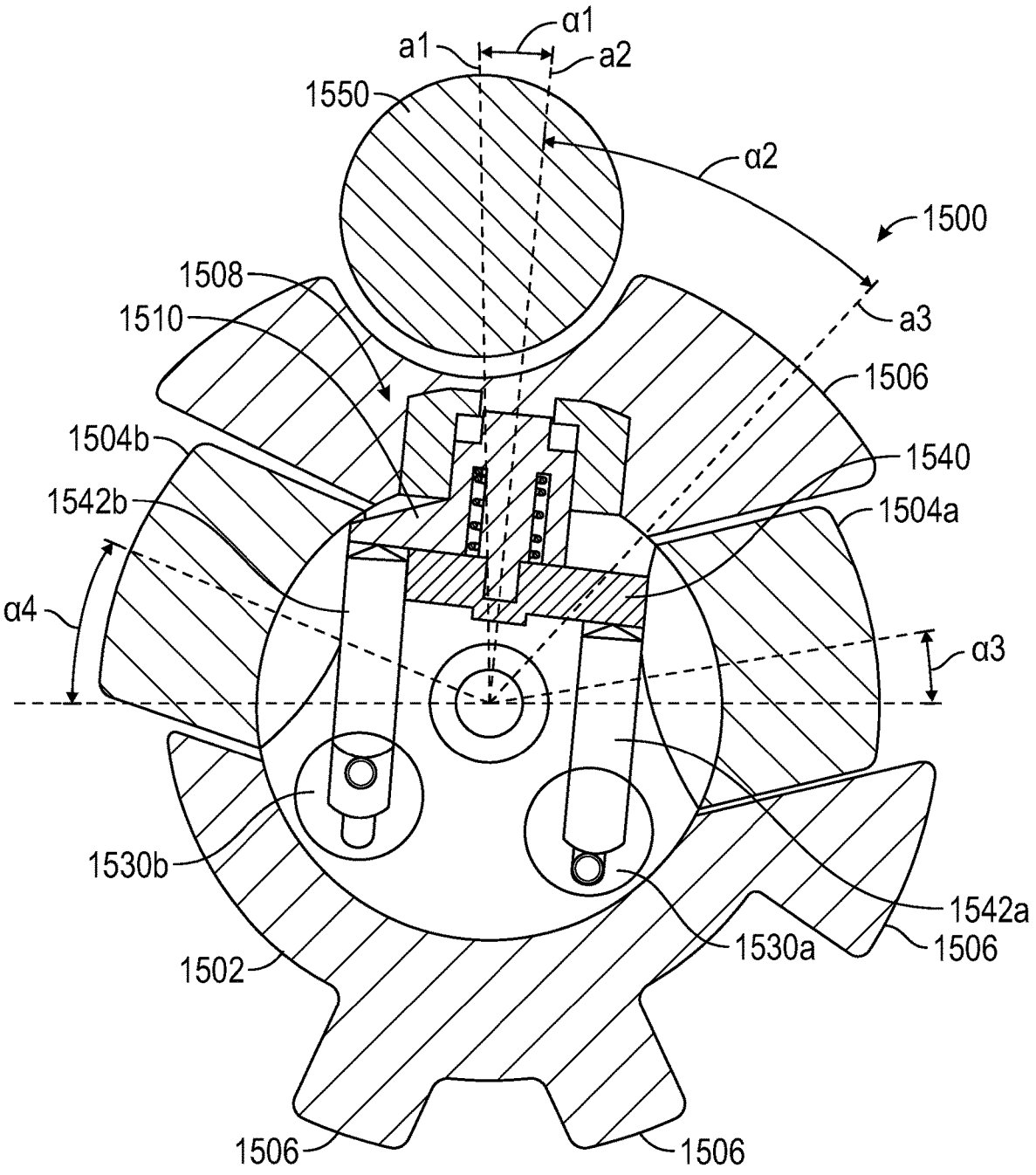
FIG. 15 is a front cross sectional view of another example of an ambidextrous firearm bolt made in accordance with the present disclosure that includes two extractors and two ejectors.

FIG. 15 is a front cross sectional view of an ambidextrous Tavor-style bolt 1500. Bolt 1500 includes first and second extractors 1504*a*, 1504*b* coupled to a bolt body 1502, the bolt also including a plurality of lugs 1506. The illustrated example includes an additional optional lug as compared to an OEM Tavor bolt. Bolt 1500 also includes first and second ejectors 1530*a*, 1530*b* and a selector assembly 1508 for selectively engaging and disengaging the extractors and ejectors. Selector assembly 1508 has the same or similar components and functionality as selector assembly 1108 (FIG. 11), including an extractor cam 1510, an ejector cam 1540 and locking pins 1542. FIG. 15 illustrates an example configuration of a Tavor-style ambidextrous bolt that enables access to selector assembly 1508 during use and without disassembly of the firearm. FIG. 15 illustrates bolt 1500 in an out of battery fully withdrawn position and shows the rotational position of selector assembly with respect to a charging rod 1550. As shown, in the out of battery fully extracted position when bolt 1500 is at the rearward extent of travel, selector assembly 1508 is rotationally offset from an axis, a1 that extends from a axial centerline of bolt 1500 through an axial centerline of charging handle by an angle, alpha 1, wherein alpha 1 may be in the range of 0 degrees to 10 degrees, and in some examples, approximately 7.5 degrees. The rotationally offset configuration ensures selector assembly 1508 will be sufficiently spaced from charging rod 1550 after bolt 1500 rotates to the in-battery position. As is well known in the art, the bolt in Tavor-style rifles typically rotates 36 degrees when it travels between the in battery and out of battery positions. Angle alpha 2 illustrates the amount of rotation, here 36 degrees. Thus, after rotation of the bolt 1500, a rotational axis of selector assembly will rotate from axis a2 to axis a3 and selector assembly will be positioned at an angle from axis a1 in the range of 36 degrees to 46 degrees, and in some examples, approximately 43.5 degrees from axis a1. Angle alpha 3 illustrates the left side ejection angle and may be in the range of 0 degrees-50 degrees and in the illustrated example approximately 10 degrees. Alpha 4 illustrates the right side ejection angle and may be in the range of 0 degrees to 50 degrees and in the illustrated example approximately 25.

Figure 16:
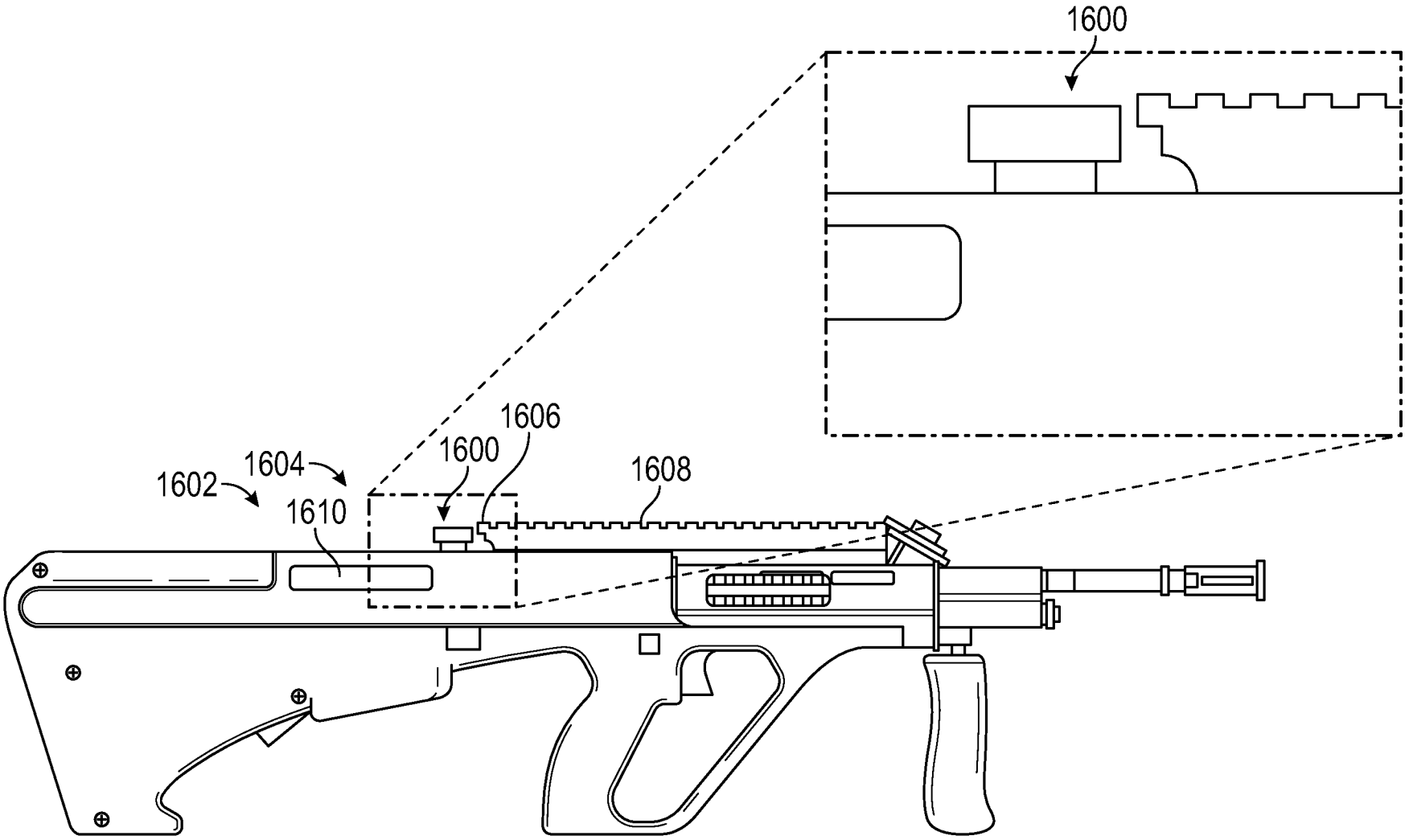
FIG. 16 is a side view of a rifle that includes a selector switch for changing the side of ejection.

FIGS. 16-23 illustrate one example of a selector switch 1600 made in accordance with the present disclosure that may be configured to operate with an ambidextrous bolt made in accordance with the present disclosure, including any of the ambidextrous bolts disclosed herein. FIG. 16 illustrates one example of a Steyr AUG-style bullpup rifle 1602 that includes an ambidextrous bolt and selector switch 1600 coupled to a barrel extension and chassis of the rifle and configured to operably couple to an ambidextrous bolt disposed in the rifle for changing the side of ejection of the rifle during use and without requiring disassembly. In the illustrated example, selector switch 600 is located on a top surface of a Steyr AUG A3 adjacent a back end 1606 of picatinny rail 1608, above the barrel extension (not illustrated) and forward of ejection port 1610. A location of selector switch 1600 on rifle 1602 is designed and selected so that the selector switch is aligned with a selector assembly of an ambidextrous bolt when the bolt is in battery. In the illustrated example, a location of the selector switch is offset from a centerline of the rifle by 15 degrees to correspond to the 15 degree rotation of the bolt when the bolt rotates from the out of battery to in-battery position. In other examples, the selector switch may be located in another location, for example, aligned with the selector when the bolt is in a fully retracted position. The selector switch 1600 is configured to be coupled to and extend from an outer surface of rifle 1602 and allow a user to selectively engage and actuate a selector assembly of an ambidextrous bolt during use.

Figure 17:
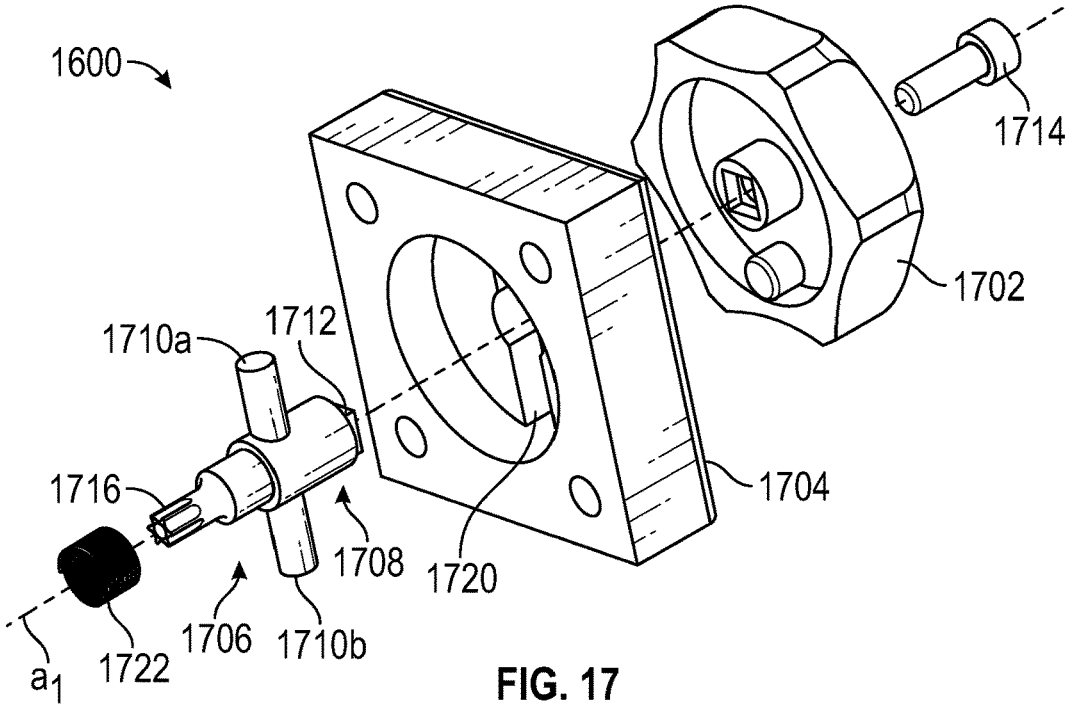
FIG. 17 is an exploded perspective view of the selector switch of FIG. 16.
Figure 18:
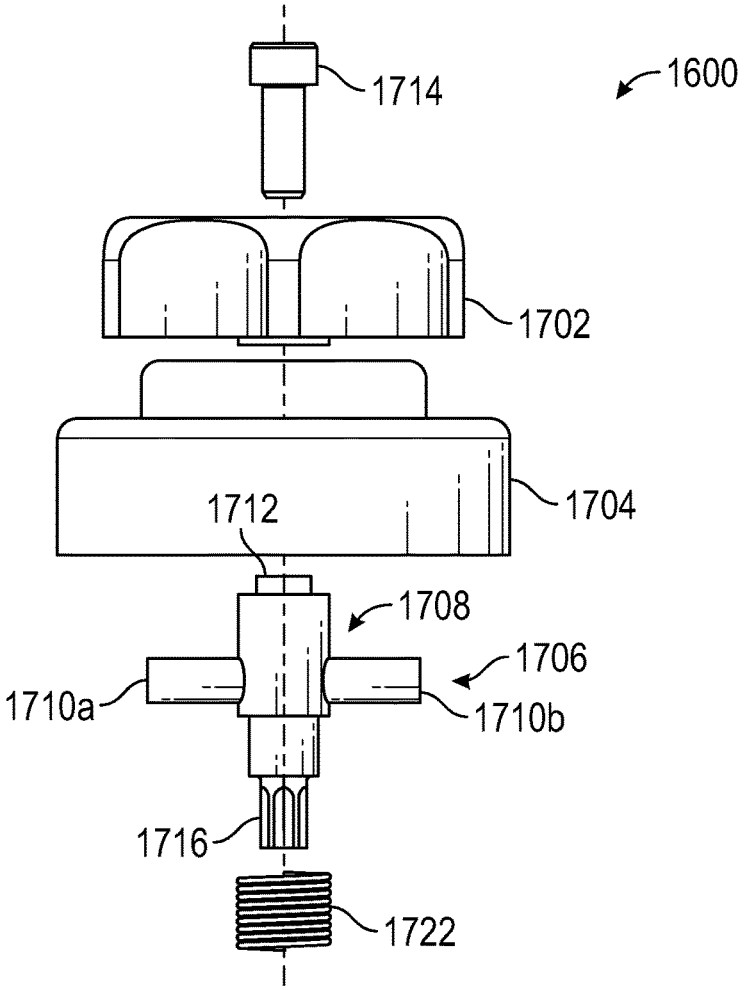
FIG. 18 is an exploded side view of the selector switch of FIG. 16.

As shown in FIG. 17, in the illustrated example, selector switch 1600 includes a first portion accessible to a user from an exterior of a firearm when the firearm is fully assembled and operable and a second portion configured to move relative to the bolt in a radial direction, the first portion including a knob 1702 disposed on a housing 1704, the housing configured to be coupled to an outer surface of a rifle, such as in the example shown in FIG. 16. The second portion of the switch 1600 including a resiliently biased actuator 1706 coupled to knob 1702 and configured to move in a linear direction along rotational axis a1 and also rotate within housing 1704 about rotational axis a1 for removably coupling to and turning a selector assembly of an ambidextrous bolt between left and right handed operation.

In the illustrated example, actuator 1706 includes a central elongate body 1708 and two laterally-projecting stops 1710*a*, 1710*b* each coupled to a mid portion of the central body that are configured to be engaged in a corresponding upper recesses 1720 in a bottom side of housing 1704. The central body 1708 also includes a threaded bore at a top end 1712 configured to receive a fastener for coupling actuator 1706 to the housing 1704 and knob 1702. Actuator 1706 also includes a male turning element 1716, such as a hex or torx key, at a second end for engaging a selector assembly, such as engaging recess 1302 in extractor cam 1110 (FIG. 13C). Selector switch 1600 also includes a spring 1722 for resiliently biasing the actuator 1706 and knob 1702 to an extended and locked position.

Figure 19:
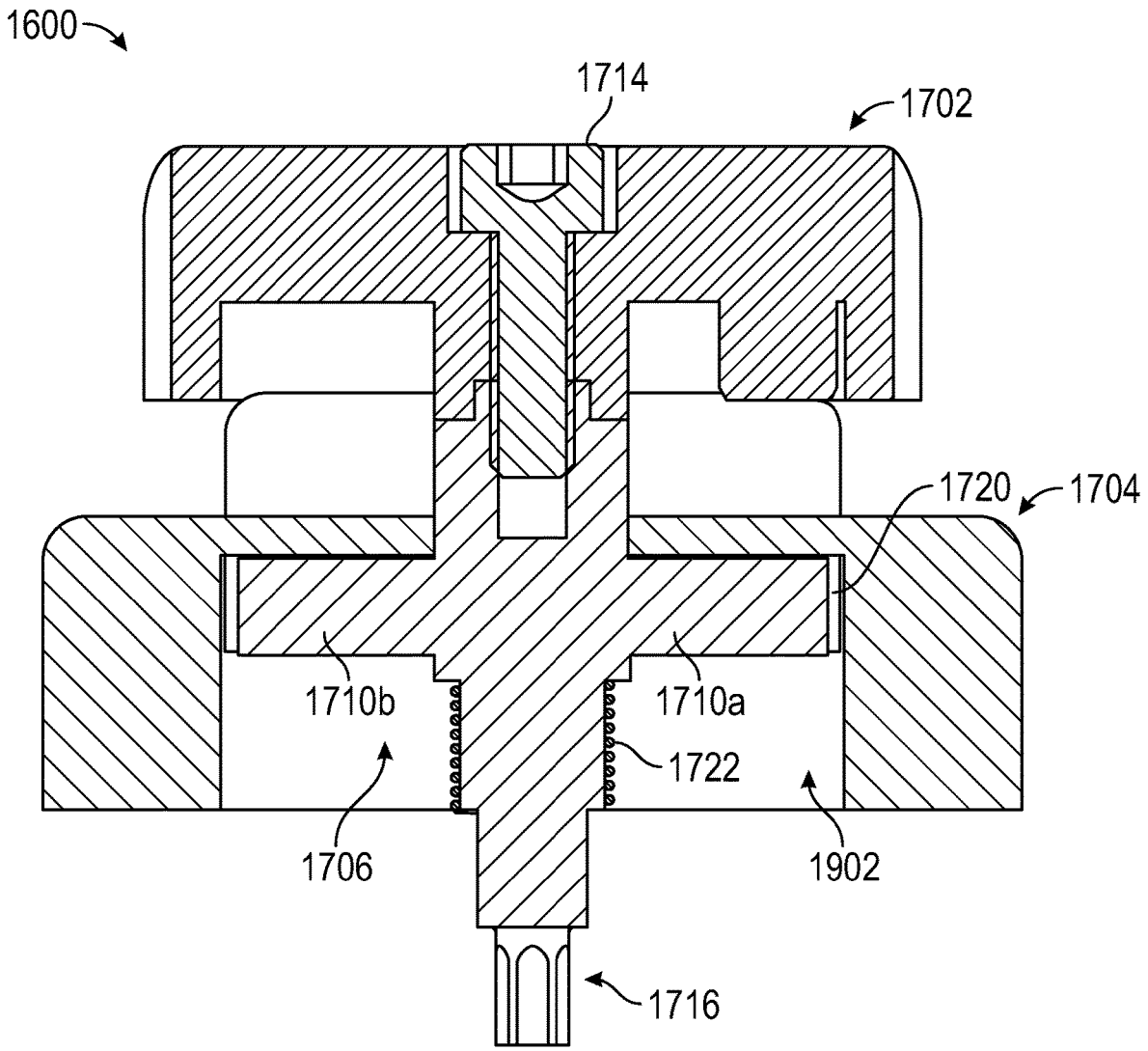
FIG. 19 is a side cross sectional view of the selector switch of FIG. 16.
Figure 20:
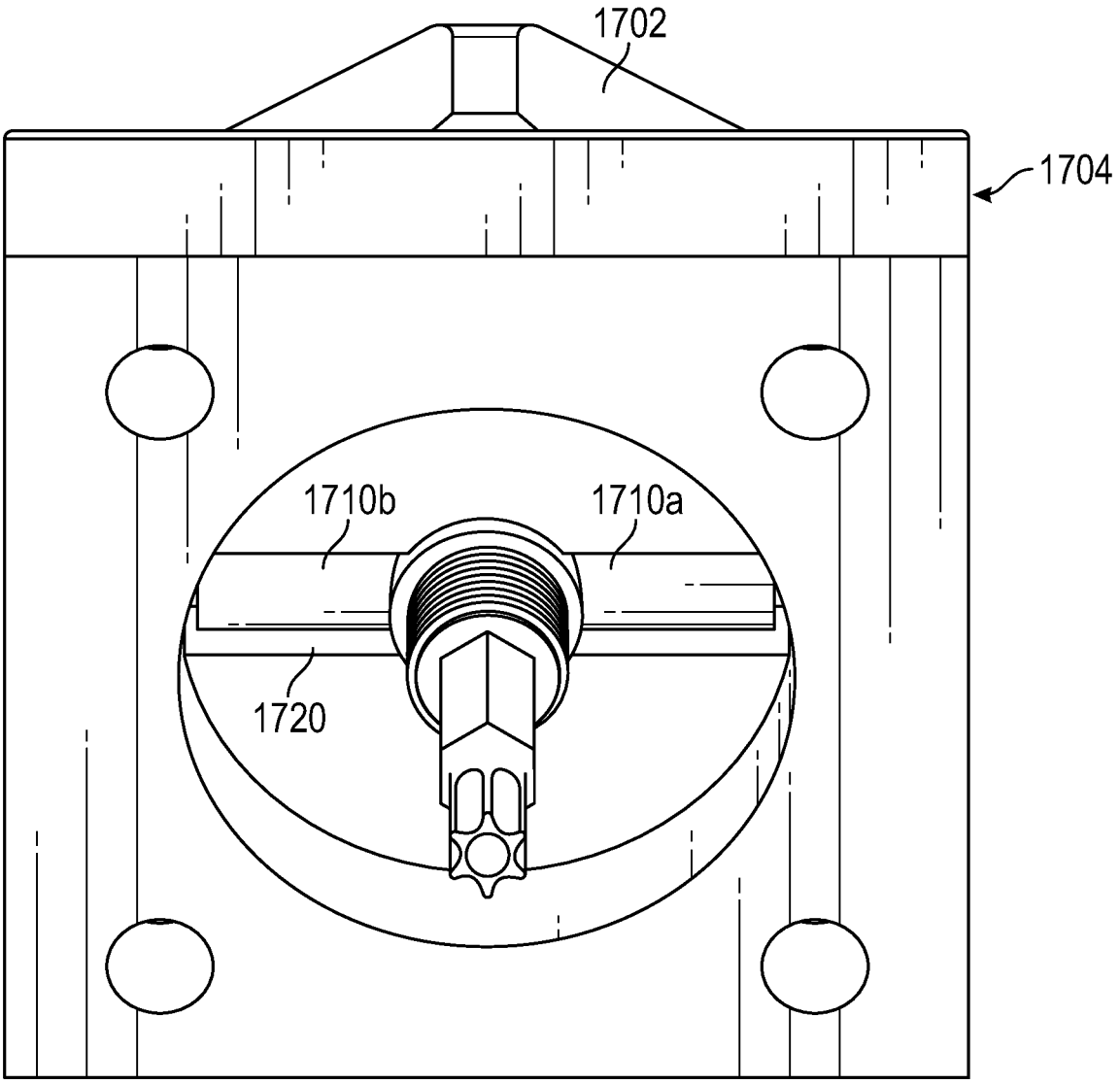
FIG. 20 is a bottom perspective view of the selector switch of FIG. 16.

FIGS. 19 and 20 show actuator 1706 in a first recessed position within housing 1704, where central body 1708 is disposed in a recess 1902 and laterally-projecting stops 1710*a*, 1710*b* are disposed in upper recess 1720. Spring 1722 is disposed on central body 1708 and resiliently biases actuator 1706 to the recessed locked position within housing 1704. In the recessed position, upper recess 1720 and stops 1710 prevent the knob 1702 from turning such that a user cannot rotate the knob without first pushing down on the knob against the force of spring 1722, thereby pushing the actuator down until lateral stops 1710 are below upper recess 1720 and the actuator is free to rotate. In the illustrated example, lower recess 1902 has a cylindrical shape with an outer diameter that is approximately the same or slightly greater than a width of the lateral stops 1710. With the lateral stops 1710 free of the upper recess 1720, a user can rotate knob 1702, thereby also rotating actuator 1706. A length of actuator 1706 and a distance of travel of the actuator when knob 1702 is depressed is sufficient for turning element 1716 to engage a selector assembly of an ambidextrous bolt when the knob is depressed to thereby rotate the selector assembly to select a side of ejection and also be spaced a sufficient distance from the bolt when the knob is released and returns to the extended position so that the actuator does not interfere with the travel of the bolt and the bolt carrier assembly.

Figure 21:
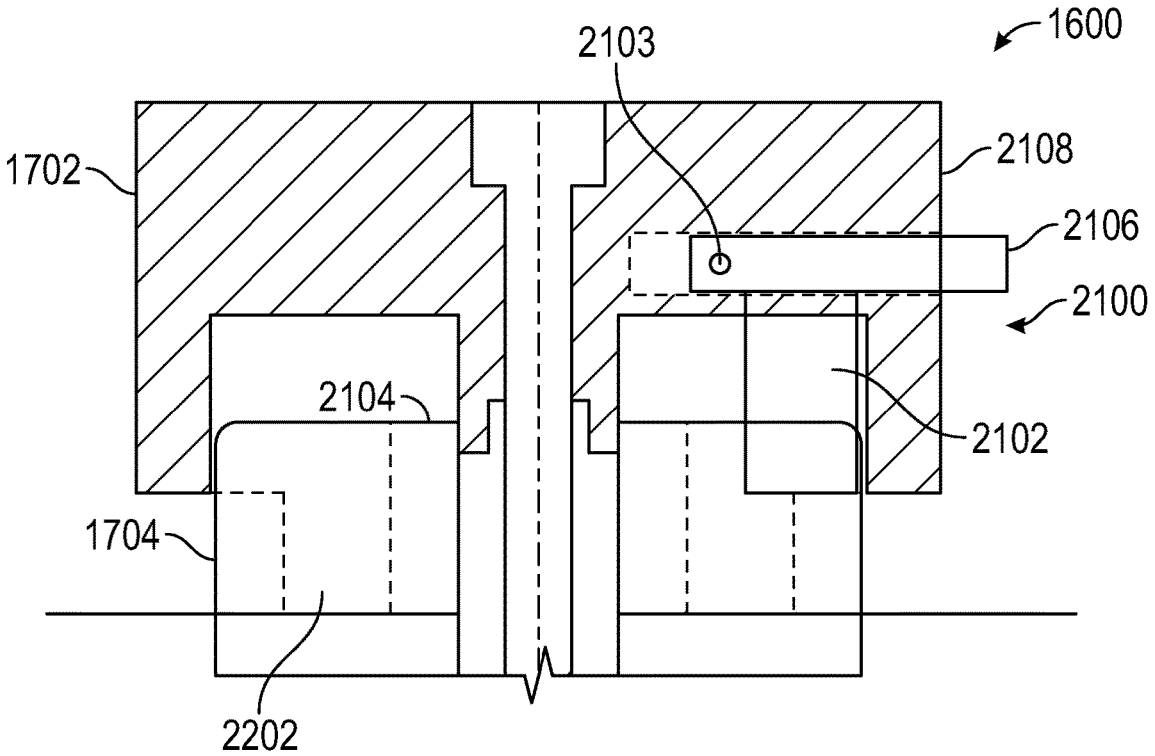
FIG. 21 is a side cross sectional view of the selector switch of FIG. 16.
Figure 22A:
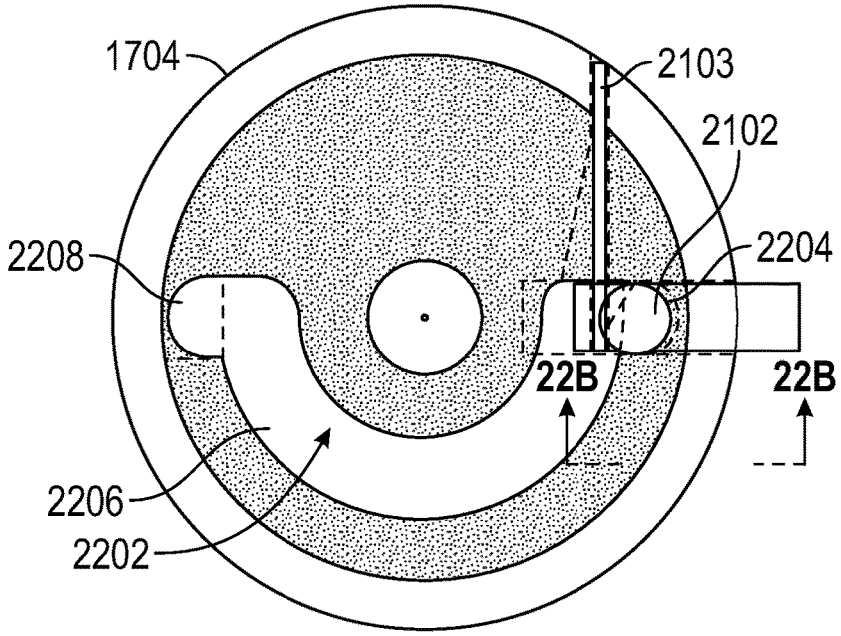
FIG. 22A is a top view of the selector switch of FIG. 16.
Figure 22B:
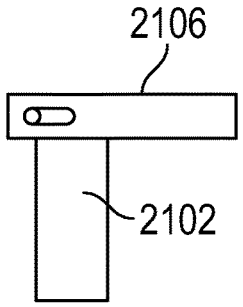
FIG. 22B is a side view of the thumb button of the selector switch of FIG. 16.

FIGS. 21-22B further illustrate aspects of selector switch 1600, including a locking mechanism 2100 that locks knob 1702 in the left or right side ejection positions and also limits the extent of rotation of the knob. Locking mechanism 2100 includes a resiliently-biased pin 2102 that is resiliently biased in a radially outward direction by a spring 2103 and that is disposed in an arcuate channel 2202 located in a top surface 2104 of housing 1704. Knob 1702 is unlocked for rotation by pressing a button 2106 that extends from a side 2108 of the knob that is coupled to pin 2102. Depressing button 2106 causes pin 2102 to move in a radially inward direction from a first end 2204 of channel 2202 to an arcuate portion 2206 of the channel. The first end 2204 and a second end 2208 of the channel have a first depth and the arcuate portion 2206 has a second depth that is greater than the first depth. With pin 2102 positioned in the arcuate portion, knob 1702 can be depressed, which causes actuator 1706 to extend into the rifle to engage a selector assembly. Knob 1702 can then be rotated to rotate actuator and the selector assembly of the bolt to change the side of ejection of the bolt. During rotation, pin 2102 travels along arcuate portion 2206 and then the pin reaches the end of the arcuate portion, channel 2202 prevents further rotation of the knob. Knob 1702 can then be released and spring 1722 (FIG. 19) will cause knob to move up to an extended position. Button 2106 can then be released (if it was not previously released) and spring 2103 will move pin 2102 in a radially outward direction so that it is disposed in second end 2208 of channel 2202. The first and second ends 2204, 2208 of channel 2202 are designed to prevent depression or rotation of knob 1702 when pin 2102 is located in one of the second ends due to the shallower depth of the first and second ends of the channel and the radially-extending sidewalls of the channel in the first and second ends. In some examples, selector switch may only include locking mechanism 2100 and not include laterally-projecting stops 1710 and upper recess 1720 or may only include laterally-projecting stops 1710 and upper recess 1720 and not include locking mechanism 2100 or any combination of the components of the two foregoing locking and rotation limiting elements.

Figure 23:
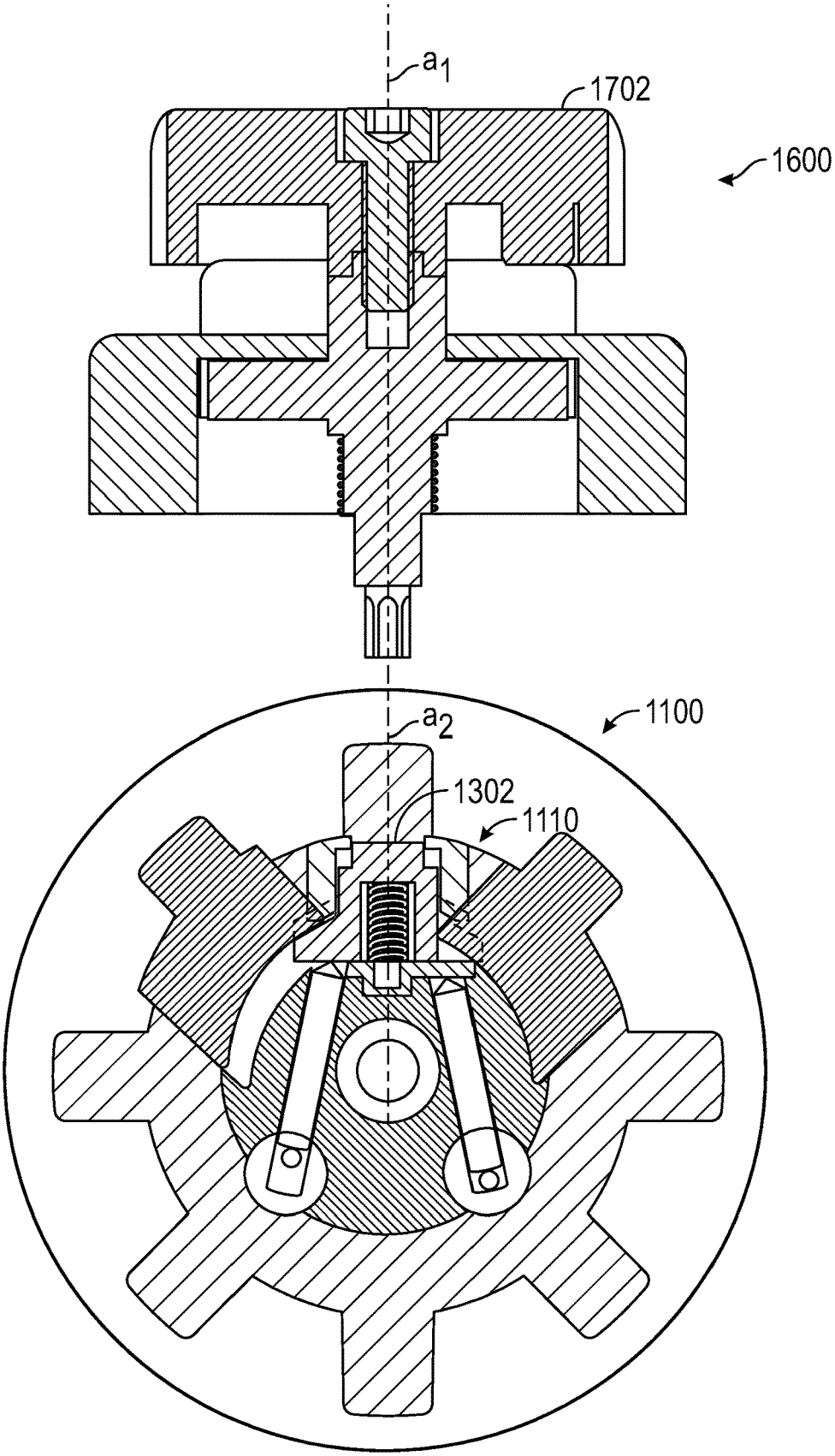
FIG. 23 is a conceptual side cross sectional view of the selector switch of FIG. 16 and the bolt of FIG. 11 in an aligned configuration.

FIG. 23 conceptually illustrates the combination of ambidextrous bolt 1100 with selector switch 1600 with other components of a firearm not illustrated. The illustrated example shows bolt 1100 in battery. When in battery, rotational axis a1 of selector switch 1600 is aligned with rotational axis a2 of selector assembly 1108 and recess 1302 in extractor cam 1110 is aligned with male turning element 1716 of actuator 1706 such that knob 1702 can be depressed to couple actuator 1706 to extractor cam 1110 to rotate the extractor cam and other components of selector assembly 1108 to change the side of ejection. In the illustrated example ambidextrous bolt 1100 with selector switch 1600 are illustrated such that rotational axes a1 and a2 are vertical. During operation of the firearm, selector switch 1600 remains in a stationary position fixed to an exterior of the rifle chassis, while ambidextrous bolt repeatedly cycles back and forth moving in a forward-rearward direction and rotating back and forth across a rotational range of motion when traveling between the in battery and out of battery positions. A location of the selector switch on the rifle chassis is selected such that the selector switch and the selector assembly of the ambidextrous bolt are aligned at a particular point of the bolt travel. In the illustrated example, the selector switch is located to align with the bolt when the bolt is in battery, however, in other examples, the selector switch may be located on the firearm so it is aligned with the bolt when it is out of battery. As will be appreciated by persons having ordinary skill in the art, this is for ease of illustration and the particular orientation can be readily modified for a particular rifle according to the particular rotational position of the bolt when in battery and the particular location where the selector switch is mounted on the exterior of the rifle.

Figures 24A, 24B:
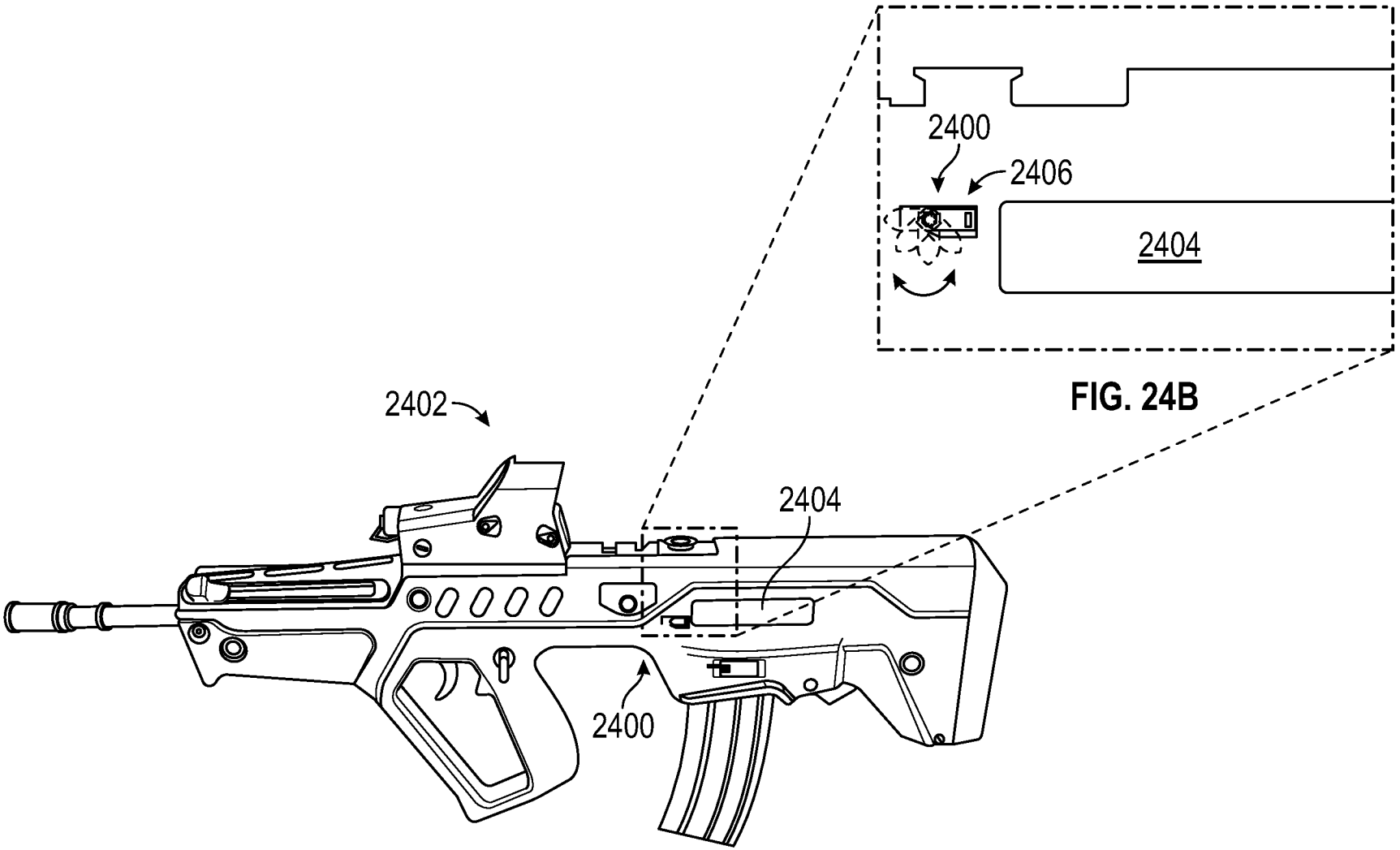
FIG. 24A is a side view of a rifle with another example of a selector switch for changing the side of ejection.
FIG. 24B is an inset view of a portion of FIG. 24A further illustrating the selector switch.

FIGS. 24-28 illustrate one example of a selector switch 2400 made in accordance with the present disclosure that may be configured to operate with an ambidextrous bolt made in accordance with the present disclosure, including any of the ambidextrous bolts disclosed herein. FIG. 24 illustrates one example of a Tavor-style bullpup rifle 2402 that includes an ambidextrous bolt and selector switch 2400 coupled to a chassis and a barrel extension of the rifle and configured to operably couple to an ambidextrous bolt disposed in the rifle for changing the side of ejection of the rifle during use and without requiring disassembly. In the illustrated example, selector switch 2400 is located on a left side of a barrel extension portion of rifle 2402 and forward of ejection port 2404. A location of selector switch 2400 on rifle 2402 is designed and selected so that the selector switch is aligned with a selector assembly of an ambidextrous bolt when the bolt is in battery. In other examples, the selector switch may be located in another location, for example, aligned with the selector when the bolt is out of battery in a fully retracted position. The selector switch 2400 is configured to be coupled to and extend from an outer surface of rifle 2402 and allow a user to selectively engage and actuate a selector assembly of an ambidextrous bolt during use. As shown in inset FIG. 24B, selector switch 2400 includes a lever 2406 that is designed to be rotated 180 degrees to change the side of ejection.

Figure 25:
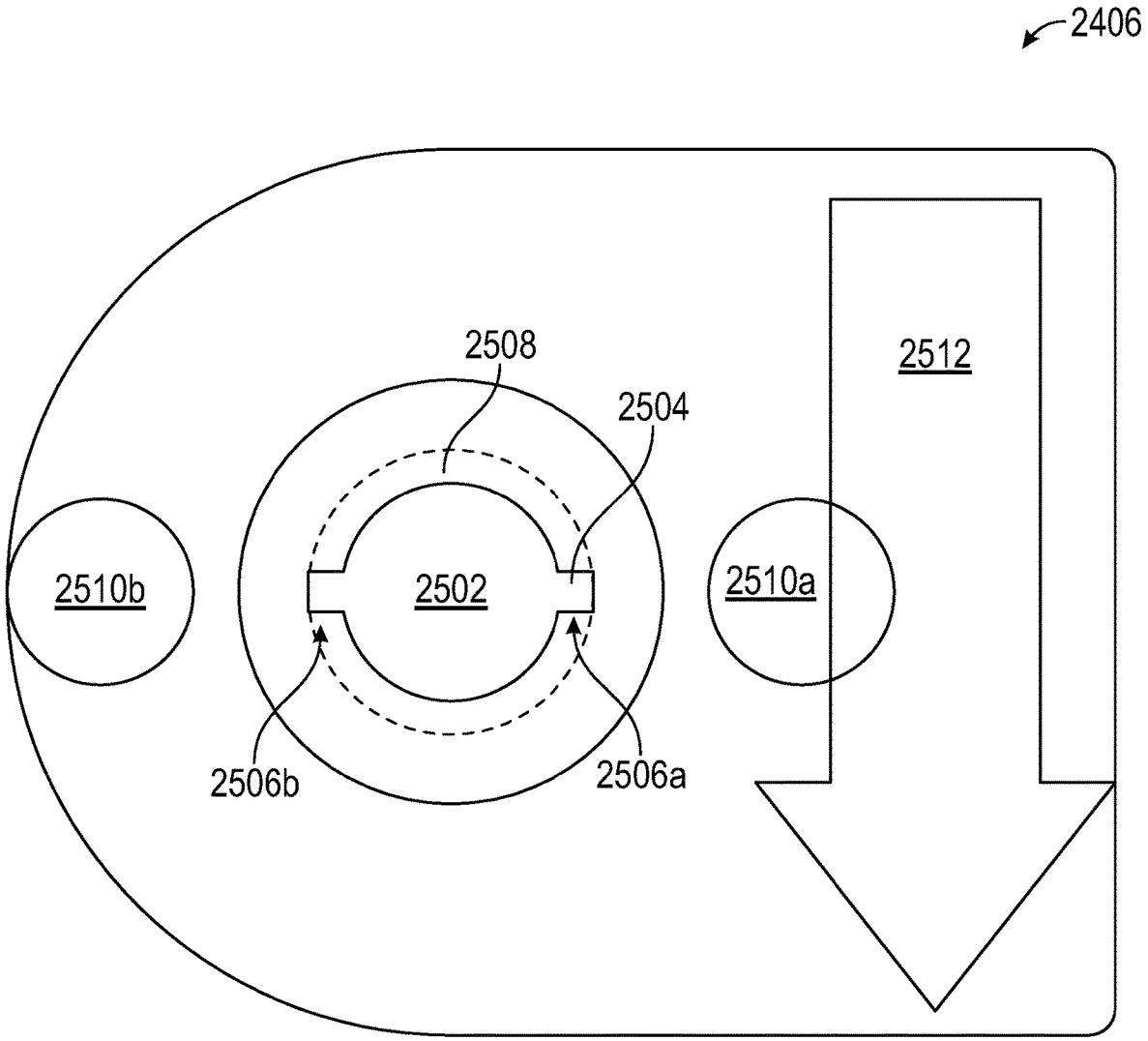
FIG. 25 is a front view of the lever of the selector switch of FIG. 24.

FIG. 25 is a front view of lever 2406 of selector switch 2400. Lever 2406 is designed to be coupled to a shaft 2502 that includes a key 2504 that is designed to travel along complementary shaped recesses 2506*a*, 2506*b* in a guide channel 2508 (see also FIG. 26). Selector switch 2400 also includes two springs 2510*a* and 2510*b* that resiliently bias lever 2406 to an extended position. In the extended portion, key 2504 is disposed in one of recesses 2506 which prevents lever 2406 from rotating. When lever 2406 is depressed a sufficient amount, key 2504 is removed from recesses 2506 and the lever is free to rotated about shaft 2502. When lever 2406 has been sufficiently depressed so that it is free to rotate a turning element of the switch will also be engaged with a selector assembly of an ambidextrous bolt so that rotation of the lever will rotate the selector assembly and change the side of ejection. Lever 2406 also includes an ejection direction indicator 2512, which can have a glow in the dark coating to improve visibility.

Figure 26:
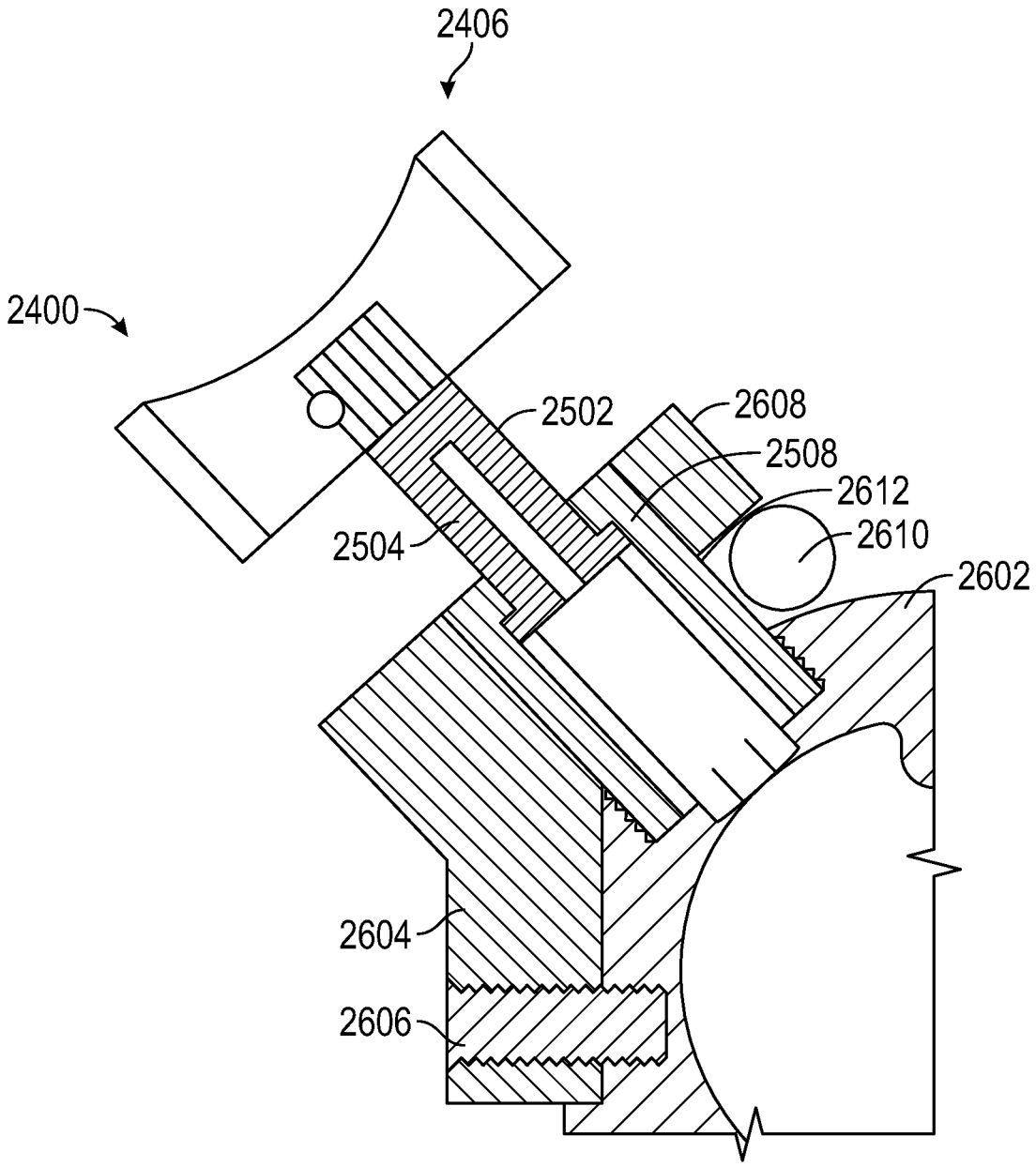
FIG. 26 is a side cross sectional view of the selector switch of FIG. 24.

FIG. 26 is a cross sectional view of a portion of a barrel extension 2602 of rifle 2402 and selector switch 2400, showing lever 2406 and shaft 2502 in an extended position. Lever 2406 and shaft 2502 are coupled to rifle 2402 by a housing 2604 by one or more fasteners 2606. In the illustrated example, a flange 2608 of housing 2604 is located above a charging handle rod 2610 of rifle 2402 and an outer wall 2612 of guide channel 2508 is positioned adjacent the charging handle rod. Guide channel 2508 is also threaded into barrel extension 2602 to securely couple the selector switch to the barrel extension and maintain proper alignment of shaft 2502 and selector assembly 1508. Selector Switch 2400 includes a first portion (lever 2406) accessible to a user from an exterior of a firearm when the firearm is fully assembled and operable and a second portion configured to move relative to the bolt in a radial direction to engage the selector assembly.

Figure 27:
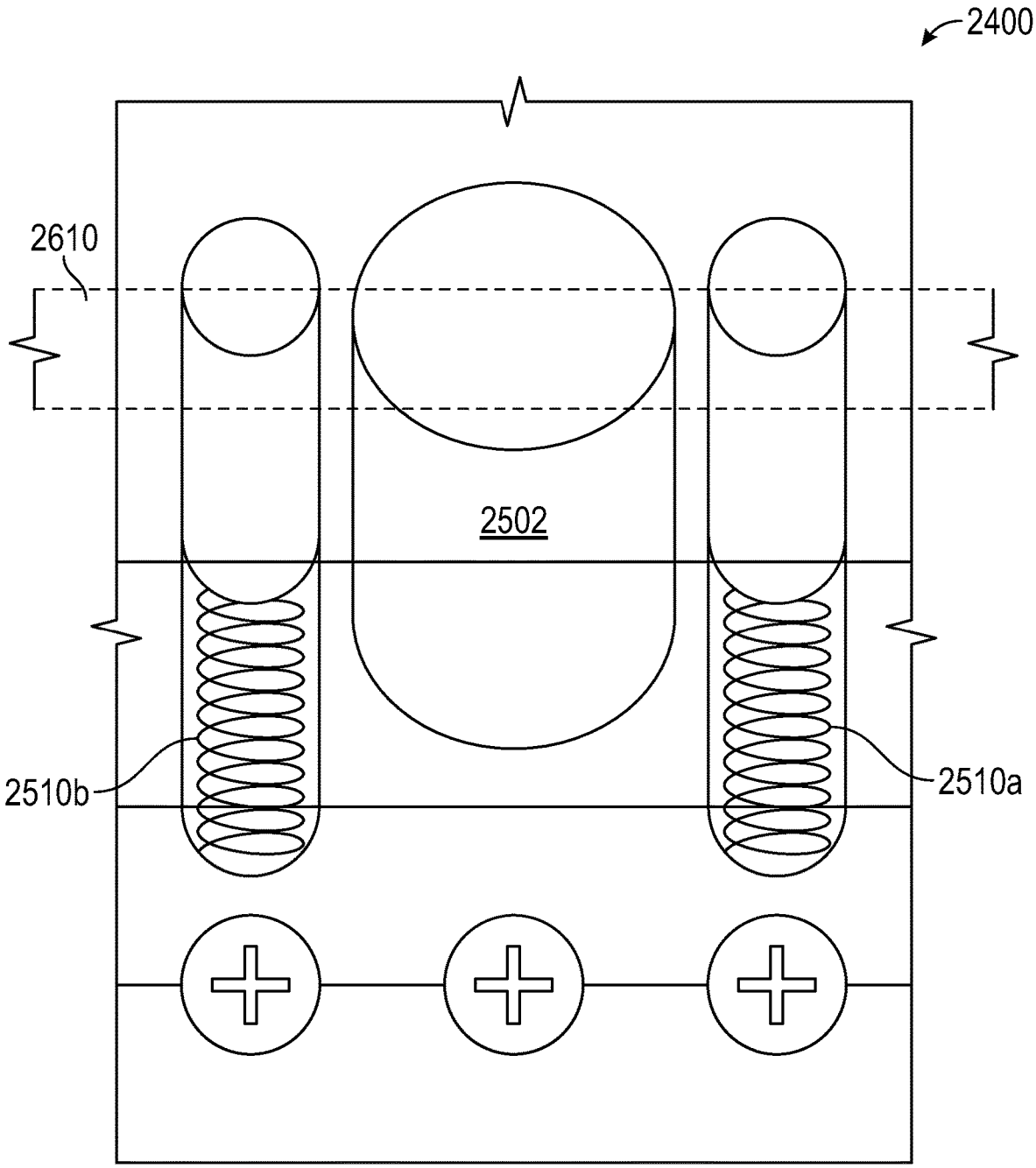
FIG. 27 is a conceptual front perspective view of portions of the selector switch of FIG. 24.
Figure 28:
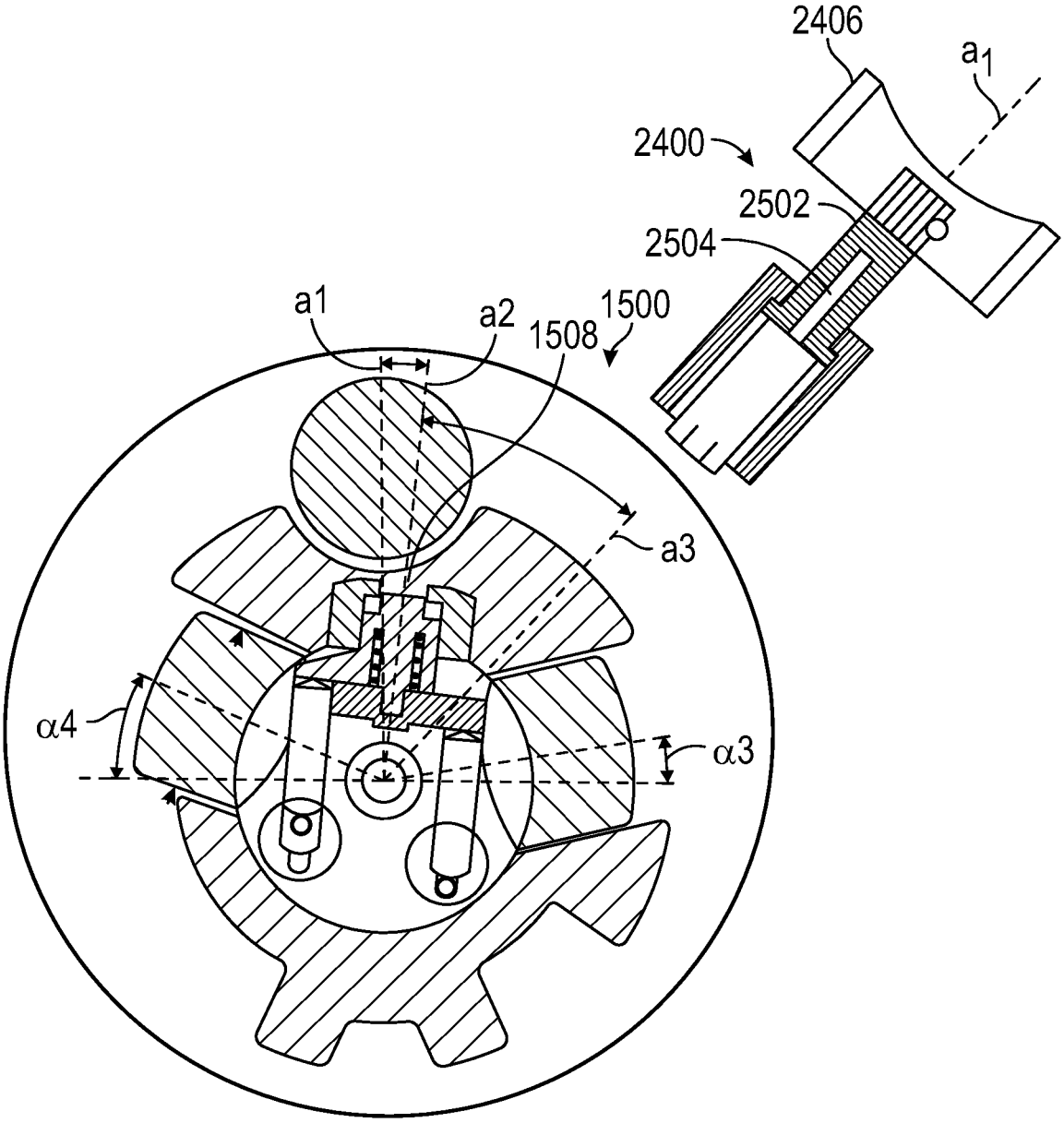
FIG. 28 is a conceptual side cross sectional view of the selector switch of FIG. 24 and the bolt of FIG. 15 in an aligned configuration.

FIG. 27 is a front perspective view of portions of selector switch 2400, including shaft 2502, springs 2510 and pin and a relative position of the switch with respect to charging handle rod 2610. FIG. 28 conceptually illustrates the combination of ambidextrous bolt 1500 (FIG. 15) with selector switch 2400 (FIG. 24). Other components of a firearm are not included for ease of illustration. The illustrated example shows bolt 1500 out of battery. When the bolt moves to the in battery position, the bolt rotates in a clockwise direction so that the rotational axis of selector assembly 1508 becomes aligned with axis a3 and rotational axis a1 of selector switch 2400 and recess 1302 in extractor cam 1510 becomes aligned with a male turning element of shaft 2502 such that lever 2406 can be depressed to couple a turning element of shaft 2502 to extractor cam 1510 to rotate the extractor cam and other components of selector assembly 1508 to change the side of ejection. In the illustrated example ambidextrous bolt 1500 and selector switch 2400 are illustrated such that when the bolt rotates into the in battery position, the rotational axis of the selector assembly 1508 and the rotational axis of the selector switch 2400 will be at an acute angle to vertical, approximately 43.5 degrees. During operation of the firearm, selector switch 2400 remains in a stationary position fixed to an exterior of the rifle chassis, while ambidextrous bolt 1500 repeatedly cycles back and forth moving in a forward-rearward direction and rotating back and forth across a rotational range of motion when traveling between the in battery and out of battery positions. A location of the selector switch on the rifle chassis is selected such that the selector switch and the selector assembly of the ambidextrous bolt are aligned at a particular point of the bolt travel. In the illustrated example, the selector switch is located to align with the bolt when the bolt is in battery, however, in other examples, the selector switch may be located on the firearm so it is aligned with the bolt when it is out of battery. As will be appreciated by persons having ordinary skill in the art, the particular orientation can be readily modified for a particular rifle according to the particular rotational position of the bolt when in battery and the particular location where the selector switch is mounted on the exterior of the rifle.

Figure 29A:
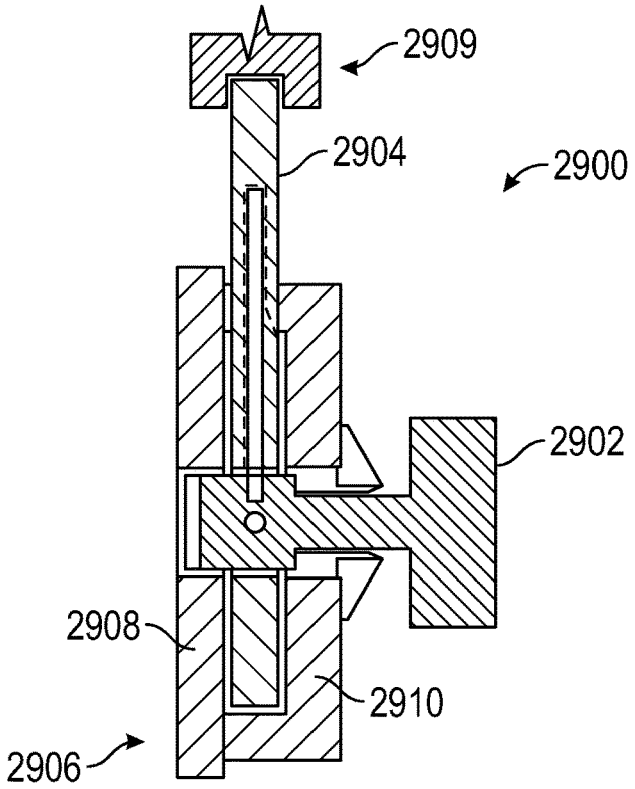
FIG. 29A is a front cross sectional view of an ejection port cover.
Figure 29B:
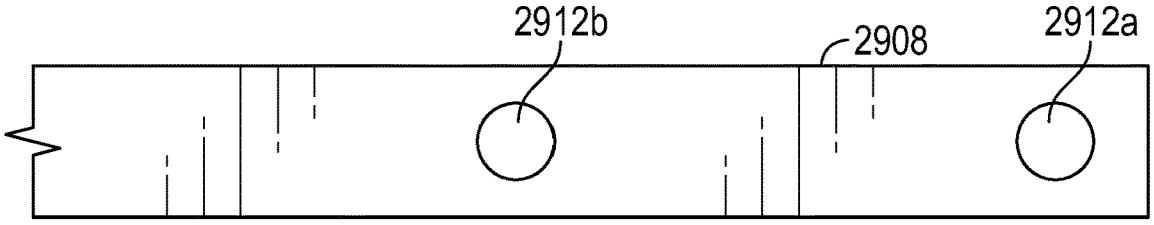
FIG. 29B is a front view of a shield plate of the ejection port cover of FIG. 29A.
Figure 29C:
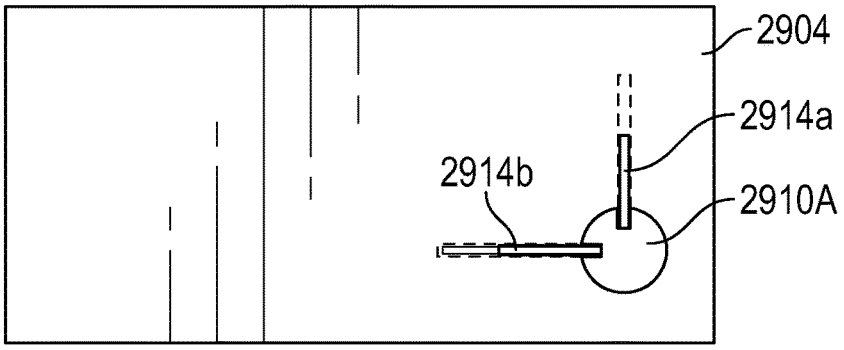
FIG. 29C is a front view of the shield of the ejection port cover of FIG. 29A.
Figure 29D:
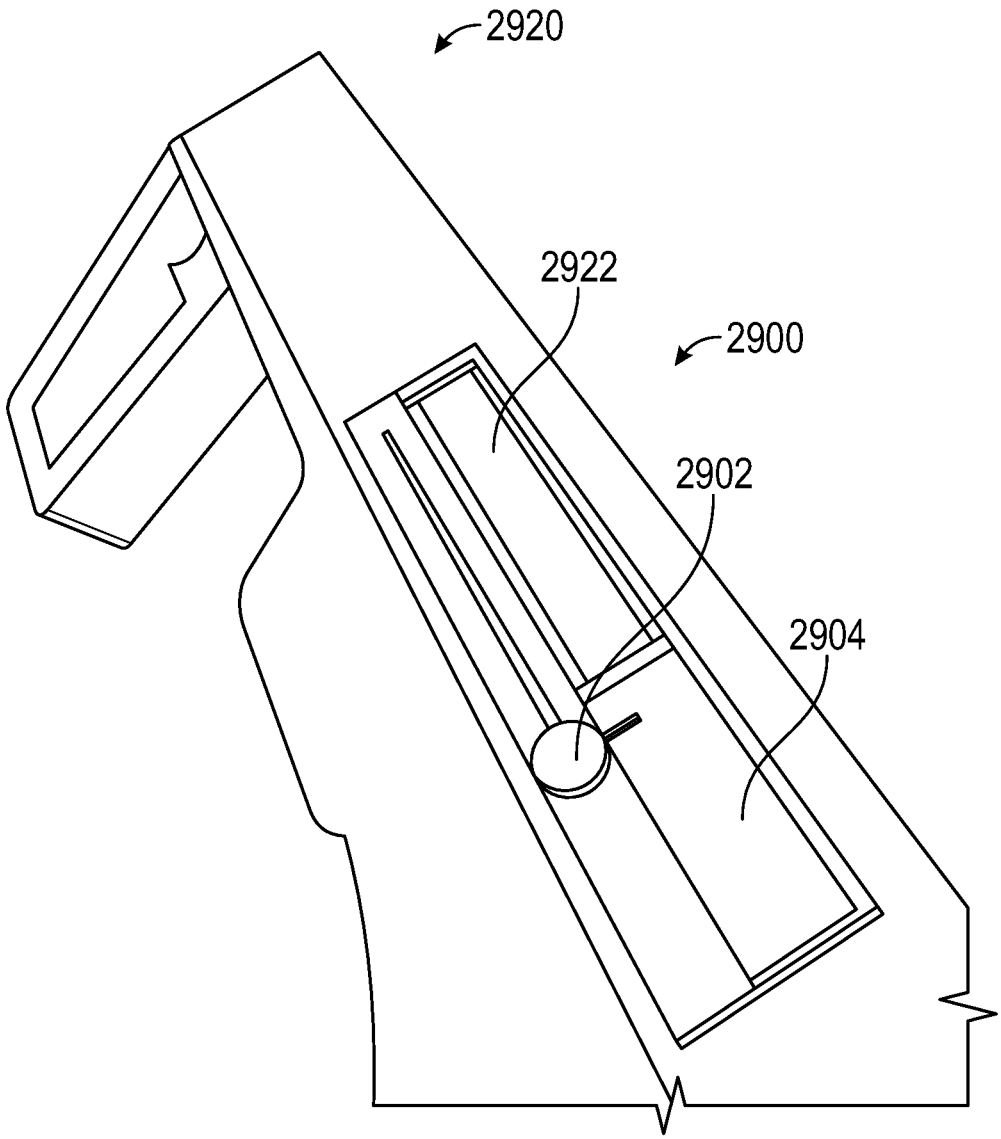
FIGS. 29D and 29E are perspective and side views of a rifle that includes the ejection port cover of FIG. 29A.
Figure 29E:
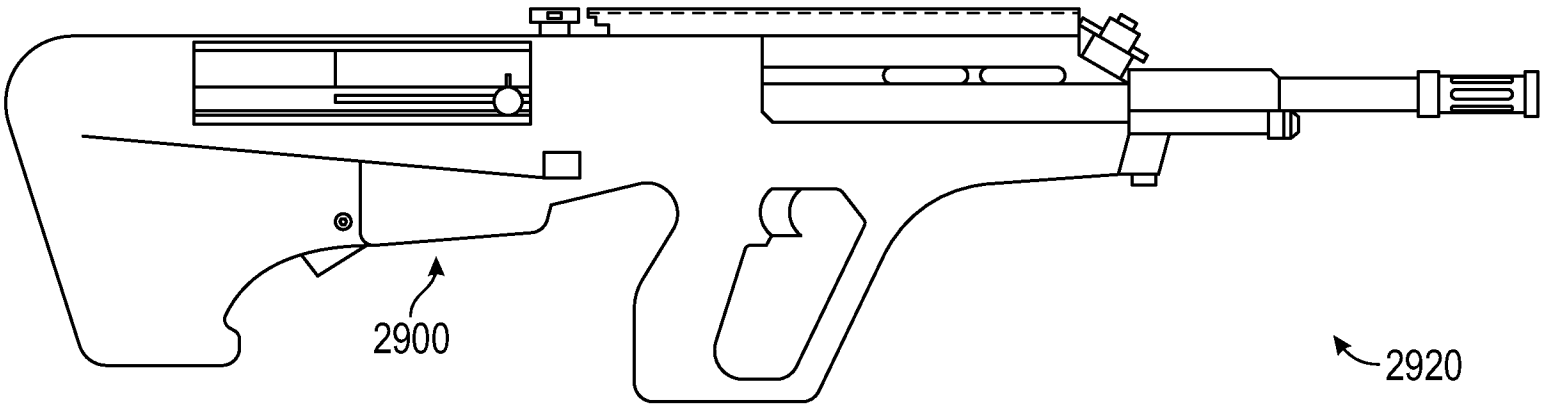

An ambidextrous rifle made in accordance with the present disclosure will typically include two ejection ports, one on each side of the rifle, to enable spent casings to be ejected from either side. The rifle may also include a removeable ejection port covers to cover the ejection port that is not in use. In some examples, a rifle may, therefore, have two ejection port covers, one on each side of the rifle to cover a corresponding ejection port. Due to the rapid nature in which the side of ejection can be changed, it can be beneficial to incorporate ejection port covers that can similarly be opened and closed easily and quickly when the side of ejection is changed. FIGS. 29A-29E illustrate one example of an ejection port cover 2900. FIG. 29A is a side cross sectional view of cover 2900 and shows a knob 2902 coupled to a shield 2904, the knob and shield slidably disposed in a housing 2906 and a top side of the shield disposed in a channel 2909. Housing 2906 includes a shield receiver plate 2908 and a guide 2910. FIG. 29B shows the shield receiver plate 2908 with openings 2912*a*, 2912*b* configured to receive knob 2902 when the cover is in the open and closed positions, respectively. FIG. 29C is another view of shield 2904 showing springs 2914*a*, 2914*b* that resiliently bias knob 2902. To open cover 2900, knob 2902 can be pulled out and shield 2904 and the knob slid in a lateral direction (for FIG. 29A, into or out of the page) to open or close the cover. FIGS. 29D and 29E are a perspective view and side view of ejection port cover 2900 disposed in a rifle 2920 having an ejection port 2922, FIG. 29D showing the cover in an open position.

Figure 30A:
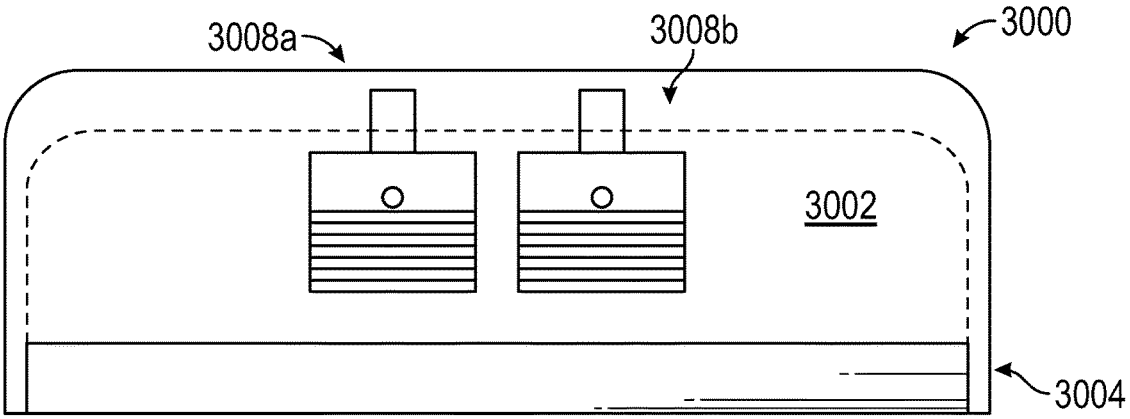
FIG. 30A is a front view of another example of an ejection port cover showing the ejection port cover in a closed position.
Figure 30B:
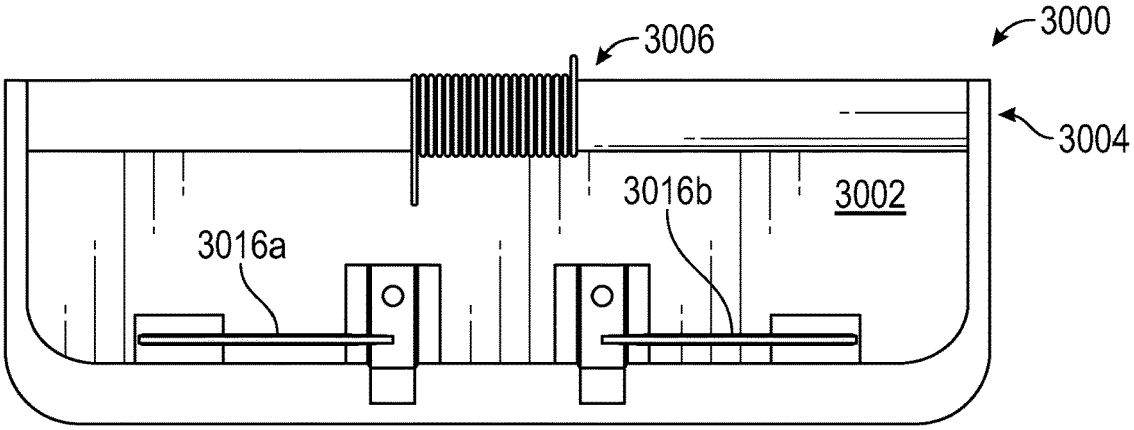
FIG. 30B is a front view of the ejection port cover of FIG. 30A showing the ejection port cover in an open position.
Figure 30C:
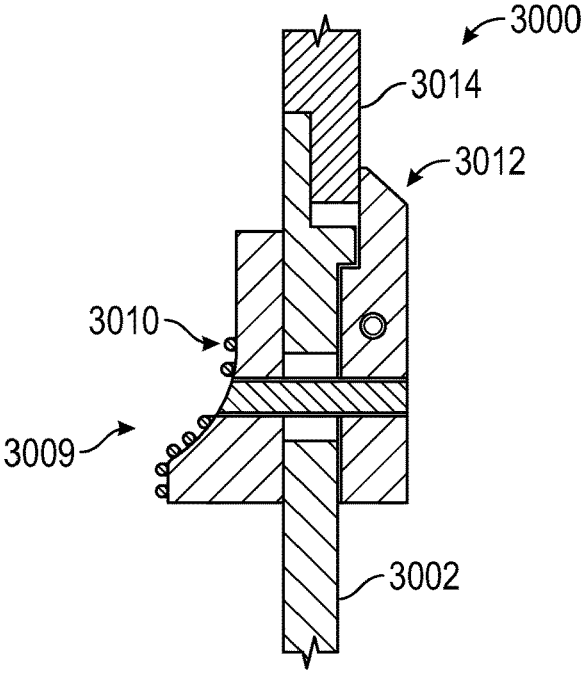
FIG. 30C is a side cross sectional view of the ejection port cover of FIGS. 30A and 30B.

FIGS. 30A-30C illustrate another example of an ejection port cover 3000 with FIG. 30A being a front view of an outer side of the cover with the cover closed, FIG. 30B showing the inner side of the cover when the cover is flipped down to open the cover and FIG. 30C is a side cross-sectional view of the cover when it is in the closed position. Ejection port cover 3000 includes a shield 3002 that is rotatably coupled to the firearm chassis at base 3004 and flips open and closed. Cover 3000 includes a spring 3006 for resiliently biasing the cover to a closed position. Cover 3000 also includes at least one latch 3008 (the illustrated example includes two latches 3008*a*, 3008*b*). Each latch 3008 includes a thumb switch 3009 that includes a curved and textured outer surface 3010 for engaging a user's thumb or finger to slide the latch down. Latch 3008 also includes a catch 3012 that engages a rear wall 3014 of the ejection port and a spring 3016 that resiliently biases the latch 3008 to a locked position.

FIGS. 31A-31D illustrate an example of an ambidextrous bolt 3100 that includes two extractor debris shields 3102 (only one illustrated), one operably coupled to each extractor 3104 for preventing the ingress of debris into the spaces between an extractor 3104 bolt body 3106. In the illustrated example, bolt 3100 is an ambidextrous bolt that has many of the same characteristics as bolt 300 (FIG. 3), including two extractors 3104*a*, 3104*b*, an ejector 3108, a plurality of lugs 3110 (only one labeled), and a cavity 3112 in bolt body 3106. In the illustrated example, cavity 3112 is designed to house components of a selector assembly (not illustrated), such as selector assembly 408 (FIG. 4) or any of the other selector assemblies disclosed herein. Cavity 3112 also includes two fastener recesses 3114 (only one illustrated) for receipt of a corresponding fastener 3116 for securing a corresponding one of debris shields 3102 to bolt body 3106.

Figure 31A:
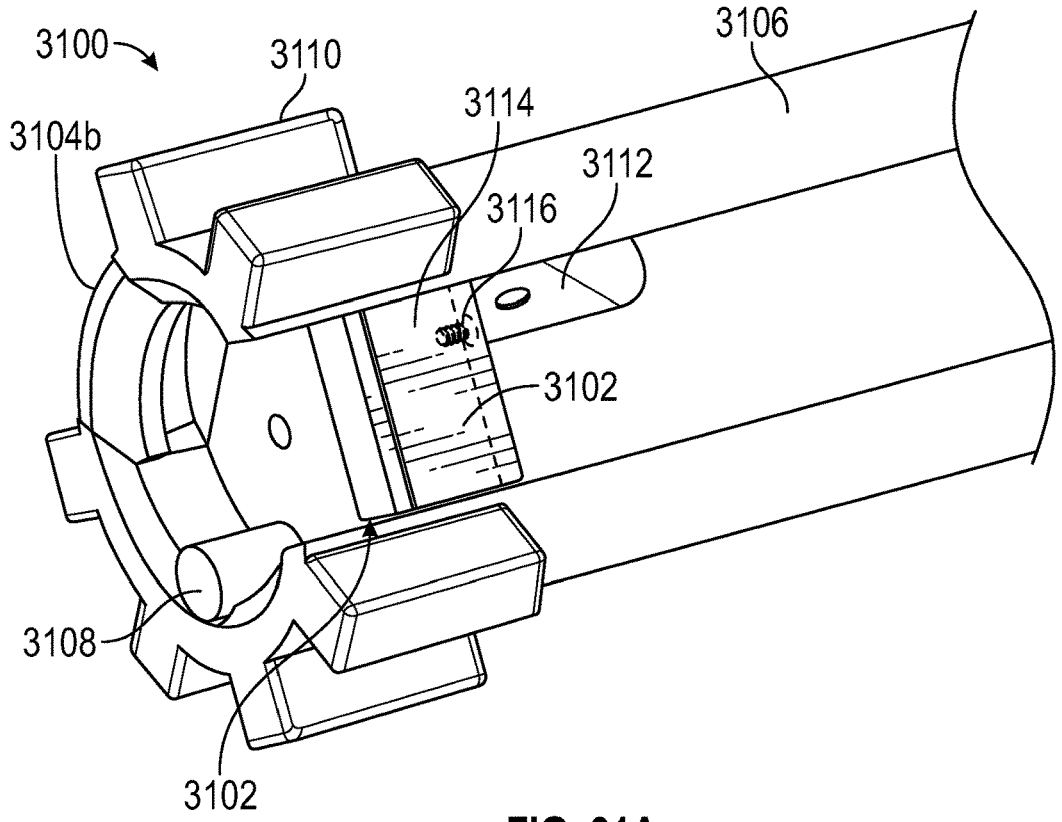
FIG. 31A is a front perspective view of an example of an ambidextrous bolt with an extractor debris shield.
Figure 31B:
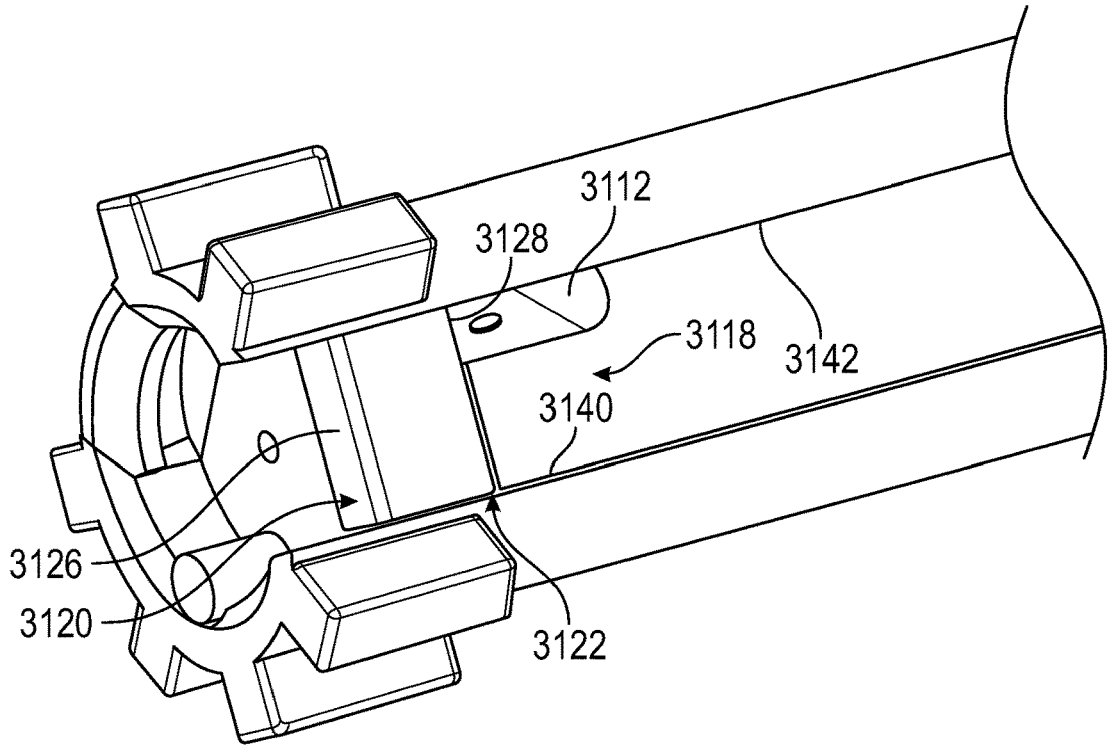
FIG. 31B is a front perspective view of the bolt of FIG. 31A with the debris shield removed.

Referring to FIG. 31B, bolt body 3106 includes two extractor recesses 3118 (only one illustrated) that are each configured and dimensioned to receive one of extractors 3104. Each of extractor recesses 3118 have a width and length that are approximately the same as a width and length of one of extractors 3104. Each of extractor recesses 3118 also include a first debris shield recess 3120 that is configured and dimensioned to receive at least a portion of debris shield 3102. In the illustrated example, each extractor recess 3118 also includes a debris shield fastening slot 3122 that is configured and dimensioned to receive a portion of a base 3124 (FIG. 31C) of the debris shield 3102. In the illustrated example, first debris shield recess 3120 is an elongate recess with a longitudinal axis that is transverse to a central longitudinal axis of bolt body 3106 and in the illustrated example, perpendicular to a plane extending through the central longitudinal axis of the bolt body, and the first debris shield recess 3120 has a length that is approximately the same as a width of extractor recess 3118 such that the shield recess and shield 3102 can cooperate to form a shield that extends across an entire width of the extractor and extends from an inner wall 3125 of the extractor to a mating surface 3126 of the extractor recess 3118 of bolt body 3106. In the illustrated example, debris shield fastening slot 3122 has a longitudinal axis that is parallel to first debris shield recess 3120 and aligned with a front wall 3128 of cavity 3112 so that base 3124 of debris shield 3102 can be disposed in slot 3122 with an end of the base located in cavity 3112 and in contact with front wall 3128. First debris shield recess 3120 and debris shield fastening slot 3122 are located in surface 3126 of extractor recess 3118 of bolt body 3106.

Figure 31C:
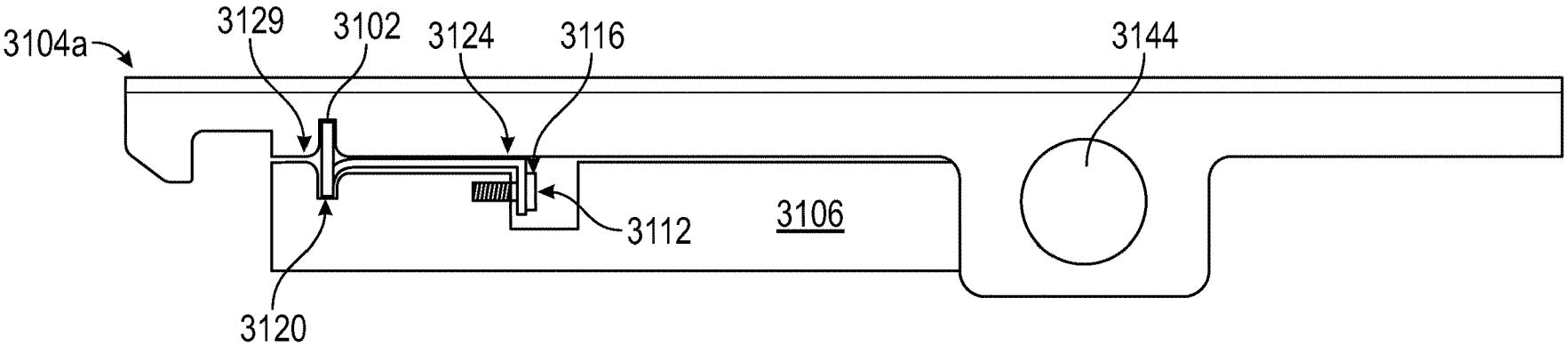
FIG. 31C is a side view of the extractor and debris shield a partial cross sectional view of the bolt of FIG. 31A, the extractor in an engaged position.
Figure 31D:
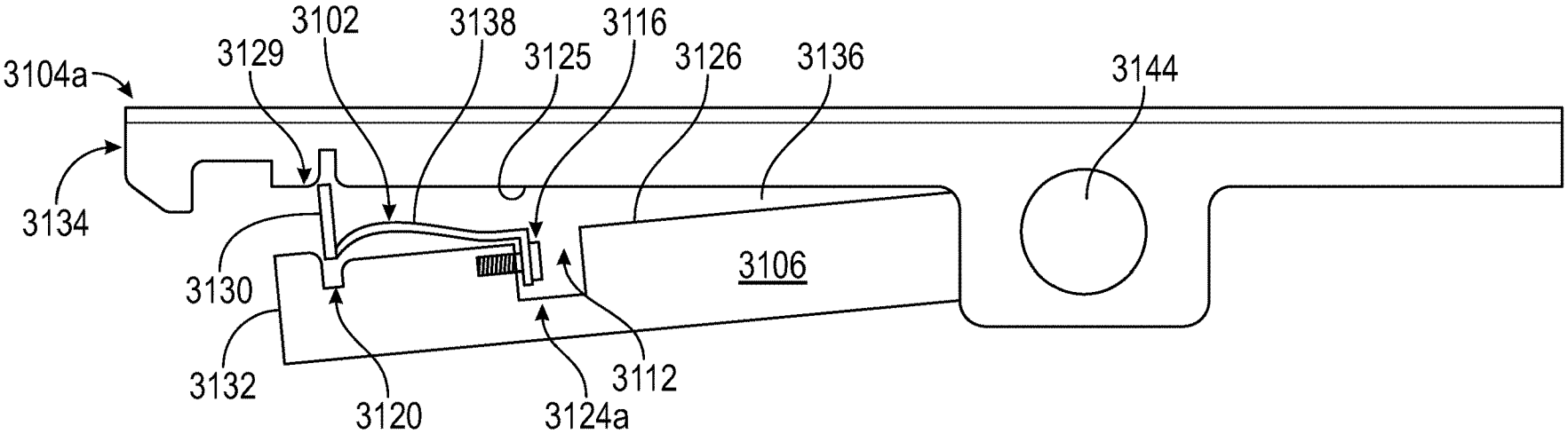
FIG. 31D shows the extractor and debris shield of FIG. 31C with the extractor pivoted to a radially outward position.

FIGS. 31C and 31D are side views of extractor 3104*a* and debris shield 3102 and a partial cross sectional view of bolt body 3106, with FIG. 31C showing the extractor in an engaged position. FIG. 31D shows the extractor in a disengaged position, where the extractor is disengaged by being moved radially outward by a selector assembly (not illustrated) made in accordance with the present disclosure, such as selector assembly 408 (FIG. 4). In the illustrated example, debris shield 3102 includes a first portion 3130 that is configured to be slidably disposed in first shield recess 3120 of bolt body 3106 and also configured to be slidably disposed in a second shield recess 3129 located in inner wall 3125 of extractor 3104*a*, the first and second shield recesses being substantially aligned and located adjacent bolt face 3132. First portion 3130 is approximately parallel to bolt face 3132 and extends in a radial direction with respect to a central longitudinal axis of bolt 3100 from bolt body 3106 to extractor 3104*a*. As shown in FIG. 31C first portion 3130 has a height that is approximately the same as the combined depth of the first and second recesses 3120, 3129 such that the first portion substantially fills the two recess when the extractor 3104*a* is in the radially inward engaged position shown in FIG. 31D. First portion 3130 extends in a transverse direction across a width of the extractor from wall 3140 to opposing wall 3142 of extractor recess 3118 to thereby provide a barrier adjacent casing-engaging end 3134 of extractor 3104*a* that prevents the ingress of debris in the spaces 3136 between the extractor and the bolt body. In the illustrated example, debris shield 3102 also includes a web 3138 that extends from first portion 3130 to base 3124 and that is configured and dimensioned to be substantially parallel to a central longitudinal axis of bolt 3100 and substantially perpendicular to first portion 3130. Base 3124 is substantially parallel to first portion 3130 and substantially perpendicular to web 3138 and configured to anchor debris shield 3102 to bolt body 3106. In other examples, debris shields made in accordance with the present disclosure may have other configurations. For example, the debris shield may not include a web 3138 or base 3124 and instead include only first portion 3130, which may be fixed to either bolt body 3106 or extractor 3104 and slidably disposed in a recess such as one of recesses 3120, 3128 in the other of the bolt body and extractor.

Although only one debris shield 3102 is illustrated, bolt 3100 may include a second debris shield on the other side of the bolt and operably coupled to extractor 3104*b*. Debris shield 3102 can be made from any of a variety of materials, for example, a metal such as spring steel. In some examples, debris shield 3102 may be designed to resiliently bias extractor 3104 towards the disengaged radially outward position shown in FIG. 31D. A debris shield such as debris shield 3102 may be incorporated into any of the bolts disclosed herein to prevent debris from entering the space between an extractor and a bolt body. Such a debris shield can be beneficial in an ambidextrous bolt to prevent debris from accessing the space between the extractor and the bolt body when an extractor is in a radially outward disengaged position (such as the position of extractor 310*a* in FIG. 8A). In the illustrated example, first portion 3130 of debris shield 3102 cooperates with opposing walls 3140, 3142 of extractor recess 3118 to fully enclose the space 3136 between the extractor and the bolt body between first portion 3130 and pivot pin 3144 to prevent the ingress of debris. Although debris shield 3102 is shown in connection with an ambidextrous bolt 3100, in other examples, a same or similarly configured debris shield may be incorporated into a prior art OEM bolt that includes only one extractor for increasing the reliability and longevity of the extractor by preventing the ingress of debris into the spaces between the extractor and the bolt body.

The foregoing has been a detailed description of illustrative embodiments of the invention. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this invention.

What is claimed:

1. An ambidextrous firearm bolt, comprising:

a bolt body;

first and second extractors pivotally coupled to the bolt body, each of the extractors having an ammunition casing engaging end, the casing engaging ends resiliently biased in a radially inward direction; and a selector assembly at least partially disposed in the bolt body and configured to selectively disengage one of the extractors to control a side of the bolt a spent casing is ejected from.

2. The ambidextrous firearm bolt of claim 1, wherein the selector assembly is configured to disengage one of the extractors by pivoting the casing engaging end of the extractor radially outward to prevent the extractor from coupling to an ammunition cartridge casing.

3. The ambidextrous firearm bolt of claim 1, wherein the selector assembly is configured to be operated during use of the firearm with the firearm fully assembled and without the need to disassemble the firearm.

4. The ambidextrous firearm bolt of claim 1, wherein the selector assembly includes a cam rotatably disposed in the bolt body, the cam including an extractor engaging end that extends laterally from a rotational axis of the cam, the extractor engaging end configured to provide a cam function that converts at least one of a rotational motion or an upward motion of the cam into a pivoting motion of one of the extractors.

5. The ambidextrous firearm bolt of claim 4, wherein the cam is resiliently biased in a radially outward direction relative to a central longitudinal axis of the bolt and is configured to be rotated between a left side ejection position and a right side ejection position.

6. The ambidextrous firearm bolt of claim 5, wherein the cam includes a key that engages a key recess that maintains the cam in the left side or right side ejection position.

7. The ambidextrous firearm bolt of claim 4, wherein the selector assembly further includes at least one locking pin for selectively locking the cam in the left side or right side ejection position, the at least one locking pin operably coupled to the cam and slidably disposed in the bolt body.

8. The ambidextrous firearm bolt of claim 7, wherein the cam includes a bottom surface and a locking pin opening located in the bottom surface, an end of each of the at least one locking pin configured to be disposed in the locking pin opening to lock the cam in the left side or right side ejection position.

9. The ambidextrous firearm bolt of claim 4, wherein the cam is resiliently biased to a locked position.

10. The ambidextrous firearm bolt of claim 1, wherein the selector assembly is configured to rotate about a rotational axis, wherein the rotational axis extends through a central longitudinal axis of the bolt, wherein the first and second extractors are located on opposing sides of the rotational axis.

11. The ambidextrous firearm bolt of claim 1, wherein the bolt further includes at least one ejector slidably disposed in the bolt body and resiliently biased to an extended position, the at least one ejector having a first end configured to press against a base of an ammunition cartridge casing coupled to the bolt body to eject the casing from the firearm, wherein the at least one ejector has a non-circular cross sectional shape that is designed and configured to maximize the effectiveness of the ejector to eject a spent casing from either side of the firearm.

12. The ambidextrous firearm bolt of claim 11, wherein the at least one ejector includes only one ejector configured to be operable with either of the first and second extractors to eject a spent casing to either side of the firearm.

13. The ambidextrous firearm bolt of claim 1, wherein the bolt further includes first and second ejectors configured to press against a base of an ammunition cartridge casing coupled to the bolt body to eject the casing from the firearm, wherein the selector assembly is further configured to selectively disengage one of the ejectors to thereby select a side of the firearm a spent casing is ejected from.

14. The ambidextrous firearm bolt of claim 13, wherein the first extractor and the first ejector are located on a left side of the bolt body and the second extractor and second ejector are located on a right side of the bolt body, the selector assembly configured to simultaneously disengage the first extractor and the second ejector when in a right side ejection configuration and simultaneously disengage the second extractor and the first ejector when in a left side ejection configuration.

15. The ambidextrous firearm bolt of claim 13, wherein the selector assembly further includes a cam for selectively disengaging one of the ejectors, the cam rotatably disposed in the bolt body.

16. The ambidextrous firearm bolt of claim 15, wherein the selector assembly further includes first and second locking pins for selectively disengaging corresponding ones of the first and second ejectors, the locking pins operably coupled to the cam and slidably disposed in the bolt body and moveable between locked and unlocked positions.

17. A ambidextrous firearm comprising:

the ambidextrous firearm bolt of claim 1; and a selector switch coupled to an upper receiver, receiver, a chassis, a bolt carrier, a slide, or a barrel extension of the firearm and configured to transition the ambidextrous firearm bolt between left and right side ejection configurations.

18. The ambidextrous firearm of claim 17, wherein the selector switch includes a first portion accessible to a user from an exterior of the firearm when the firearm is fully assembled and operable and a second portion configured to move relative to the bolt in a radial direction to engage the bolt.

19. The ambidextrous firearm of claim 18, wherein during operation, the ambidextrous firearm bolt moves relative to the selector switch in an axial direction between an in battery position and an out of battery position, the second portion configured to couple to the ambidextrous firearm bolt when the bolt is in the in battery position.

20. The ambidextrous firearm of claim 18, wherein the first portion is a user-operated turning element configured to be disposed on an exterior of the firearm.

21. A firearm, comprising:

the ambidextrous firearm bolt of claim 1;

a left side ejection port located on a left side of the firearm and a right side ejection port located on a right side of the firearm, the firearm configured to selectively eject a spent casing through either of the ejection ports; and ejection port covers located on corresponding ones of the left side and right side ejection ports that are each operable between a closed position and an open position for closing the one of the ejection ports the firearm is not configured to eject a spent casing through and opening the ejection port the firearm is configured to eject a spent casing through.

22. The firearm of claim 21, wherein the ejection port covers are slidably or pivotally coupled to the firearm.

23. The firearm of claim 21, wherein when the ejection port covers are in the closed position, the cover remains closed during the firing of a round of ammunition by the firearm.

24. The firearm of claim 21, wherein when the ejection port covers each include a user-actuatable control element integrally formed with the cover for rapid opening and closing of the cover.

25. A method of operating a firearm that includes an ambidextrous firearm bolt having a selector assembly configured to selectively disengage one of first and second extractors to control a side of the bolt a spent casing is ejected from, the method comprising:

while firearm is fully assembled and operable and without disassembly of the firearm, coupling to the selector assembly; and rotating the selector assembly to engage the one of the extractors that was disengaged and disengage the one of the extractors that was engaged to thereby change a side of the firearm the bolt is configured to eject spent casings from;

wherein the rotating step includes rotating a cam that includes an extractor engaging end to press one of the extractors in a radially outward direction to disengage the extractor.

26. The method of claim 25, wherein the rotating step further includes rotating the cam to selectively lock one of a plurality of ejectors and unlock another one of the plurality of ejectors.

27. The method of claim 25, wherein the step of rotating the cam includes moving one of two locking pins from a locked position to an unlocked position and moving the other one of the locking pins from an unlocked position to a locked position.

28. The ambidextrous firearm bolt of claim 7, wherein the cam includes a first portion that includes the extractor engaging end and a second portion that engages the at least one locking pin.

29. The ambidextrous firearm bolt of claim 28, wherein the cam is a unitary member that includes the first and second portions.

30. The ambidextrous firearm bolt of claim 28, wherein the ambidextrous firearm bolt includes only one ejector.

* * * * *